US008858267B2

(12) United States Patent
Hashim et al.

(10) Patent No.: US 8,858,267 B2
(45) Date of Patent: Oct. 14, 2014

(54) COMMUNICATIONS PLUGS AND PATCH CORDS WITH MODE CONVERSION CONTROL CIRCUITRY

(71) Applicant: CommScope, Inc. of North Carolina, Hickory, NC (US)

(72) Inventors: Amid I. Hashim, Plano, TX (US); Richard A. Schumacher, Dallas, TX (US)

(73) Assignee: CommScope, Inc. of North Carolina, Hickory, NC (US)

( * ) Notice: Subject to any disclaimer, the term of this patent is extended or adjusted under 35 U.S.C. 154(b) by 0 days.

(21) Appl. No.: 13/803,160

(22) Filed: Mar. 14, 2013

(65) Prior Publication Data

US 2014/0273624 A1 Sep. 18, 2014

(51) Int. Cl.

| | |
|---|---|
| ***H01R 24/00*** | (2011.01) |
| ***H01R 13/66*** | (2006.01) |
| ***H01R 13/658*** | (2011.01) |

(52) U.S. Cl.

CPC ..... *H01R 13/658* (2013.01); *H01R 13/66* (2013.01)

USPC ..... 439/676

(58) Field of Classification Search

USPC ..... 439/607.01, 676, 607.21, 941, 439/620.21–620.23, 344

See application file for complete search history.

(56) References Cited

U.S. PATENT DOCUMENTS

| | | | | |
|---|---|---|---|---|
| 5,967,853 | A | 10/1999 | Hashim | |
| 7,201,618 | B2 | 4/2007 | Ellis et al. | |
| 7,204,722 | B2 | 4/2007 | Hashim et al. | |
| 7,220,149 | B2 | 5/2007 | Pharney | |
| 7,857,635 | B2 | 12/2010 | Goodrich et al. | |
| 7,967,645 | B2 * | 6/2011 | Marti et al. | 439/676 |
| 8,128,437 | B2 * | 3/2012 | Straka et al. | 439/676 |
| 8,696,386 | B2 * | 4/2014 | Larsen et al. | 439/620.21 |
| 2001/0021608 | A1 * | 9/2001 | Borbolla et al. | 439/676 |
| 2006/0121788 | A1 * | 6/2006 | Pharney | 439/676 |
| 2007/0178772 | A1 | 8/2007 | Hashim et al. | |
| 2010/0062644 | A1 | 3/2010 | Aekins et al. | |
| 2011/0041331 | A1 | 2/2011 | Caveney et al. | |
| 2012/0100744 | A1 | 4/2012 | Bolouri-Saransar et al. | |
| 2012/0184154 | A1 | 7/2012 | Straka et al. | |

FOREIGN PATENT DOCUMENTS

KR 10-2010-0106427 A 10/2010

OTHER PUBLICATIONS

Notification of Transmittal of the International Search Report and the Written Opinion of the International Searching Authority, or the Declaration, for PCT/US2014/020973, mailing date: Jun. 20, 2014, 18 pages.

* cited by examiner

*Primary Examiner* — Jean F Duverne

(74) *Attorney, Agent, or Firm* — Myers Bigel Sibley & Sajovec, P.A.

(57) ABSTRACT

Patch cords include a communications cable that has first through eighth conductors that are arranged as four twisted pairs and a plug attached thereto. The plug includes a housing that receives the cable, first through eighth plug contacts, and a printed circuit board that includes first through eighth conductive paths that connect the first through eighth conductors to the respective first through eighth plug contacts. The plug further includes a first crosstalk injection circuit between the second conductive path and the sixth conductive path and a second crosstalk injection circuit between the first conductive path and the sixth conductive path.

22 Claims, 14 Drawing Sheets

COMMUNICATIONS PLUGS AND PATCH CORDS WITH MODE CONVERSION CONTROL CIRCUITRY

FIELD OF THE INVENTION

The present invention relates generally to communications connectors and, more particularly, to communications plugs such as RJ-45 plugs that may exhibit improved crosstalk performance when mated with a communications jack to form a mated plug-jack connection.

BACKGROUND

Many hardwired communications systems use plug and jack connectors to connect a communications cable to another communications cable or to computer equipment. By way of example, high speed communications systems routinely use such plug and jack connectors to connect computers, printers and other devices to local area networks and/or to external networks such as the Internet. FIG. 1 depicts a highly simplified example of such a hardwired high speed communications system that illustrates how plug and jack connectors may be used to interconnect a computer 11 to, for example, a network server 20.

As shown in FIG. 1, the computer 11 is connected by a cable 12 to a communications jack 15 that is mounted in a wall plate 19. The cable 12 is a patch cord that includes a communications plug 13, 14 at each end thereof. Typically, the cable 12 includes eight insulated conductors. As shown in FIG. 1, plug 14 is inserted into a cavity or "plug aperture" 16 in the front side of the communications jack 15 so that the contacts or "plug blades" of communications plug 14 mate with respective contacts of the communications jack 15. If the cable 12 includes eight conductors, the communications plug 14 and the communications jack 15 will typically each have eight contacts. The communications jack 15 includes a wire connection assembly 17 at the back end thereof that receives a plurality of conductors (e.g., eight) from a second cable 18 that are individually pressed into slots in the wire connection assembly 17 to establish mechanical and electrical connections between each conductor of the second cable 18 and a respective one of a plurality of conductive paths through the communications jack 15. The other end of the second cable 18 is connected to a network server 20 which may be located, for example, in a telecommunications closet. Communications plug 13 similarly is inserted into the plug aperture of a second communications jack (not pictured in FIG. 1) that is provided in the back of the computer 11. Thus, the patch cord 12, the cable 18 and the communications jack 15 provide a plurality of electrical paths between the computer 11 and the network server 20. These electrical paths may be used to communicate information signals between the computer 11 and the network server 20.

When a signal is transmitted over a conductor (e.g., an insulated copper wire) in a communications cable, electrical noise from external sources may be picked up by the conductor, degrading the quality of the signal. In order to counteract such noise sources, the information signals in the above-described communications systems are typically transmitted between devices over a pair of conductors (hereinafter a "differential pair" or simply a "pair") rather than over a single conductor. The two conductors of each differential pair are twisted tightly together in the communications cables and patch cords so that the eight conductors are arranged as four twisted differential pairs of conductors. The signals transmitted on each conductor of a differential pair have equal magnitudes, but opposite phases, and the information signal is embedded as the voltage difference between the signals carried on the two conductors of the pair. When the signal is transmitted over a twisted differential pair of conductors, each conductor in the differential pair often picks up approximately the same amount of noise from these external sources. Because the information signal is extracted by taking the difference of the signals carried on the two conductors of the differential pair, the subtraction process may mostly cancel out the noise signal, and hence the information signal is typically not disturbed.

Referring again to FIG. 1, it can be seen that a series of plugs, jacks and cable segments connect the computer 11 to the server 20. Each plug, jack and cable segment includes four differential pairs, and thus a total of four differential transmission lines are provided between the computer 11 and the server 20 that may be used to carry two way communications therebetween (e.g., two of the differential pairs may be used to carry signals from the computer 11 to the server 20, while the other two may be used to carry signals from the server 20 to the computer 11). The cascaded plugs, jacks and cabling segments shown in FIG. 1 that provide connectivity between two end devices (e.g., computer 11 and server 20) is referred to herein as a "channel." Thus, in most high speed communications systems, a "channel" includes four differential pairs. Unfortunately, the proximities of the conductors and contacting structures within each plug-jack connection (e.g., where plug 14 mates with jack 15) can produce capacitive and/or inductive couplings. These capacitive and inductive couplings in the connectors (and similar couplings that may arise in the cabling) give rise to another type of noise that is known as "crosstalk."

In particular, "crosstalk" refers to unwanted signal energy that is capacitively and/or inductively coupled onto the conductors of a first "victim" differential pair from a signal that is transmitted over a second "disturbing" differential pair. The induced crosstalk may include both near-end crosstalk (NEXT), which is the crosstalk measured at an input location corresponding to a source at the same location (i.e., crosstalk whose induced voltage signal travels in an opposite direction to that of an originating, disturbing signal in a different path), and far-end crosstalk (FEXT), which is the crosstalk measured at the output location corresponding to a source at the input location (i.e., crosstalk whose signal travels in the same direction as the disturbing signal in the different path). Both types of crosstalk comprise an undesirable noise signal that interferes with the information signal that is transmitted over the victim differential pair.

While methods are available that can significantly reduce the effects of crosstalk within communications cable segments, the communications connector configurations that were adopted years ago—and which still are in effect in order to maintain backwards compatibility—generally did not arrange the contact structures so as to minimize crosstalk between the differential pairs in the connector hardware. For example, pursuant to the ANSI/TIA-568-C.2 standard approved Aug. 11, 2009 by the Telecommunications Industry Association, in the connection region where the contacts of a modular plug mate with the contacts of the modular jack (referred to herein as the "plug-jack mating region"), the eight contacts 1-8 of the jack must be aligned in a row, with the eight contacts 1-8 arranged as four differential pairs specified as depicted in FIG. 2. As known to those of skill in the art, under the TIA/EIA 568 type B configuration, contacts 4 and 5 in FIG. 2 comprise pair 1, contacts 1 and 2 comprise pair 2, contacts 3 and 6 comprise pair 3, and contacts 7 and 8 comprise pair 4. Contacts 1, 3, 5 and 7 are the so-called "tip"

contacts, while contacts 2, 4, 6 and 8 are the "ring" contacts. As is apparent from FIG. 2, this arrangement of the eight contacts 1-8 will result in unequal coupling between the differential pairs, and hence both NEXT and FEXT is introduced in each connector in industry standardized communications systems. The unequal coupling that occurs as a result of the industry standardized RJ-45 plug-jack interface is typically referred to as "offending" crosstalk.

As hardwired communications systems have moved to higher frequencies in order to support increased data rate communications, crosstalk in the plug and jack connectors has became a more significant problem. To address this problem, communications jacks now routinely include crosstalk compensation circuits that introduce "compensating" crosstalk that is used to cancel much of the "offending" crosstalk that is introduced in the plug-jack mating region as a result of the industry-standardized connector configurations. In order to ensure that plugs and jacks manufactured by different vendors will work well together, the industry standards specify amounts of offending crosstalk that must be generated between the various differential pair combinations in an RJ-45 plug for that plug to be industry-standards compliant. Thus, while it is now possible to manufacture RJ-45 plugs that exhibit much lower levels of offending crosstalk, it is still necessary to ensure that RJ-45 plugs inject the industry-standardized amounts of offending crosstalk between the differential pairs so that backwards compatibility will be maintained with the installed base of RJ-45 plugs and jacks. Typically, so-called "multi-stage" crosstalk compensation circuits are used. Such crosstalk circuits are described in U.S. Pat. No. 5,997,358 to Adriaenssens et al., the entire content of which is hereby incorporated herein by reference as if set forth fully herein.

Crosstalk can be classified as either differential crosstalk or as common mode crosstalk. Differential crosstalk refers to a crosstalk signal that appears as a difference in voltage between two conductors of a victim differential pair. This type of crosstalk degrades any information signal carried on the victim differential pair as the difference in voltage does not subtract out when the information signal carried on the victim differential pair is extracted by taking the difference of the voltages carried by the conductors on the victim differential pair. Common mode crosstalk refers to a crosstalk signal that appears on both conductors of a differential pair. Common mode crosstalk typically does not disturb the information signal on the victim differential pair, as the disturbing common mode signal is cancelled by the subtraction process used to recover the information signal on the victim differential pair.

Common mode crosstalk, however, can generate another type of crosstalk called "alien" crosstalk. Alien crosstalk refers to crosstalk that occurs between two communication channels. Alien crosstalk can arise, for example, in closely spaced connectors (e.g., patch panels) or in communications cables that are bundled together. For example, a differential pair in a first communications cable can crosstalk with a differential pair in a second, immediately adjacent communications cable. Common mode signals that may be carried on a differential pair are particularly likely to generate alien crosstalk, as common mode signals are generally not self-cancelling in the way that differential signals are. Obviously, physical separation between connectors and cables may be used to reduce alien crosstalk. However, this is typically impractical because bundling of cables and patch cords and locating communications connectors in close proximity on patch panels is common practice due to "real estate" constraints and/or ease of wire management.

SUMMARY

Pursuant to embodiments of the present invention, patch cords are provided that include a communications cable that has first through eighth conductors. The fourth and fifth conductors are twisted together to form a first twisted pair, the first and second conductors are twisted together to form a second twisted pair, the third and sixth conductors are twisted together to form a third twisted pair, and the seventh and eighth conductors are twisted together to form a fourth twisted pair. A plug is attached to the communications cable. This plug includes a housing that receives the communications cable and first through eighth plug contacts that include plug contact regions that are substantially aligned in a row in numerical order. The plug further includes a printed circuit board that has first through eighth conductive paths that connect the first through eighth conductors to the respective first through eighth plug contacts. A first portion of the first conductive path and a first portion of the second conductive path are routed as a transmission line, and a first portion of the sixth conductive path is routed therebetween.

In some embodiments, the first portion of the first conductive path, the first portion of the second conductive path and the first portion of the sixth conductive path are all on the same side of the printed circuit board. In other embodiments, the first portion of the first conductive path and the first portion of the second conductive path are on a first layer of the printed circuit board, and the first portion of the sixth conductive path is on a second layer of the printed circuit board that is different than the first layer. A first portion of the seventh conductive path and a first portion of the eighth conductive path may also be routed in side-by-side fashion as a transmission line, and a first portion of the third conductive path may be routed therebetween. The third and sixth conductive paths may cross over each other at least twice and/or may form an expanded loop on the printed circuit board.

In some embodiments, the first portion of the sixth conductive path may be configured to couple substantially equal amounts of energy onto the first portions of the first and second conductive paths when a signal is incident on the sixth conductive path. The first portion of the sixth conductive path that is routed between the first portions of the first and second conductive paths may comprise a differential-to-common mode crosstalk cancellation circuit that at least partially cancels the common mode crosstalk that is injected from the third plug contact onto the first and second plug contacts. At least a portion of the differential-to-common mode crosstalk cancellation circuit may be located on a front half of the printed circuit board that receives the first through eighth plug blades.

Pursuant to further embodiments of the present invention, patch cords are provided that include a communications cable that has first through eighth conductors. The fourth and fifth conductors are twisted together to form a first twisted pair, the first and second conductors are twisted together to form a second twisted pair, the third and sixth conductors are twisted together to form a third twisted pair, and the seventh and eighth conductors are twisted together to form a fourth twisted pair. A plug is attached to the communications cable. This plug includes a housing that receives the communications cable and first through eighth plug contacts that include plug contact regions that are substantially aligned in a row in numerical order. The plug further includes a printed circuit board that has first through eighth conductive paths that connect the first through eighth conductors to the respective first through eighth plug contacts. On the printed circuit board, a first portion of the second conductive path is closer to the seventh and eight conductive paths than is a first portion of the sixth conductive path, and a first portion of the seventh conductive path is closer to the first and second conductive paths than is a first portion of the third conductive path.

In some embodiments, the first portion of the sixth conductive path is routed between substantially parallel first portions of the first and second conductive paths. The first portion of the sixth conductive path may be substantially equidistant from the first portions of the first and second conductive paths. The first portion of the sixth conductive path may be configured to couple substantially equal amounts of energy onto the first portions of the first and second conductive paths. The first portions of the first and second conductive paths may be routed generally side-by-side as a differential transmission line, and the first portion of the sixth conductive path may be routed between the first portions of the first and second conductive paths.

Pursuant to still further embodiments of the present invention, patch cords are provided that include a communications cable that has first through fourth conductors. The first and second conductors form a first differential pair, and the third and fourth conductors form a second differential pair. A plug is attached to the communications cable. This plug includes a housing that receives the communications cable and first through fourth plug contacts. The plug further includes a printed circuit board that has first through fourth conductive paths that connect the first through fourth conductors to the respective first through fourth plug contacts. The third plug contact injects common mode crosstalk onto the first and second plug contacts, and the fourth conductive path includes a section that couples with the first and second conductive paths to at least partially cancel this common mode crosstalk.

In some embodiments, the first through fourth plug contacts include plug contact regions that are substantially aligned in a row in numerical order, and/or the third and fourth conductive paths form an expanded loop on the printed circuit board. First portions of the first and second conductive paths may be routed in side-by-side fashion as a transmission line, and a first portion of the fourth conductive path may be routed therebetween. The first portions of the first, second and fourth conductive paths may all be on the same side of the printed circuit board. The third and fourth conductive paths may cross over each other at least twice. The first portion of the fourth conductive path may be configured to couple substantially equal amounts of energy onto the first portions of the first and second conductive paths.

Pursuant to still further embodiments of the present invention, patch cords are provided that include a communications cable that has first through eighth conductors, where the fourth and fifth conductors are twisted together to form a first twisted pair, the first and second conductors are twisted together to form a second twisted pair, the third and sixth conductors are twisted together to form a third twisted pair, and the seventh and eighth conductors are twisted together to form a fourth twisted pair. A plug is attached to the communications cable. The plug has a housing that receives the communications cable, first through eighth plug contacts that include plug contact regions that are substantially aligned in a row in numerical order, and a printed circuit board that is at least partly within the housing. The printed circuit board includes first through eighth conductive paths that connect the first through eighth conductors to the respective first through eighth plug contacts. A first portion of the sixth conductive path is routed so that, when excited by a signal, it will couple substantially equal amounts of signal energy onto a first portion of the first conductive path and a first portion of the second conductive path.

In some embodiments, the first portion of the sixth conductive path includes a first current carrying path that is positioned adjacent the first portion of the first conductive path and a second current carrying path that is positioned adjacent the first portion of the second conductive path. In such embodiments, the first portion of the first conductive path, the first portion of the second conductive path and the first portion of the sixth conductive path may all be on the same layer of the printed circuit board. In some embodiments, the first portion of the first conductive path and the first portion of the second conductive path may be between the first current carrying path of the first portion of the sixth conductive path and the second current carrying path of the first portion of the sixth conductive path. In other embodiments, the first current carrying path of the first portion of the sixth conductive path may be vertically stacked with the first portion of the first conductive path and the second current carrying path of the first portion of the sixth conductive path may be vertically stacked with the first portion of the second conductive path In some embodiments, the first portion of the first conductive path and the first portion of the second conductive path may be on a first layer of the printed circuit board, and the first portion of the sixth conductive path may be a widened trace that is on a second layer of the printed circuit board that is different than the first layer. In some embodiments, the first portion of the sixth conductive path may overlap the first portion of the first conductive path and the first portion of the second conductive path. The printed circuit board may be a flexible printed circuit board. The first portion of the sixth conductive path may be routed between the first portion of the first conductive path and the first portion of the second conductive path.

Pursuant to additional embodiments of the present invention, patch cords are provided that include a communications cable that has first through eighth conductors. The fourth and fifth conductors are twisted together to form a first twisted pair, the first and second conductors are twisted together to form a second twisted pair, the third and sixth conductors are twisted together to form a third twisted pair, and the seventh and eighth conductors are twisted together to form a fourth twisted pair. A plug is attached to the communications cable. This plug includes a housing that receives the communications cable and first through eighth plug contacts. The plug further includes a printed circuit board that has first through eighth conductive paths that connect the first through eighth conductors to the respective first through eighth plug contacts. A first crosstalk injection circuit is provided between the second conductive path and the sixth conductive path, and a second crosstalk injection circuit is provided between the first conductive path and the sixth conductive path.

In some embodiments, the first and second crosstalk injection circuits substantially cancel the common mode crosstalk injected from the third twisted pair onto the second twisted pair when the third twisted pair is excited differentially. The plug may also include a third crosstalk injection circuit between the second conductive path and the third conductive path. In such embodiments, the first, second and third crosstalk injection circuits may substantially cancel the common mode crosstalk injected from the third twisted pair onto the second twisted pair when the third twisted pair is excited differentially. In other embodiments, the plug includes a third crosstalk injection circuit that is provided between the first conductive path and the third conductive path.

In some embodiments, the first crosstalk injection circuit comprises a first capacitor on the printed circuit board between the second conductive path and the sixth conductive path. Likewise, the second crosstalk injection circuit may be a second capacitor on the printed circuit board between the first conductive path and the sixth conductive path. The first capacitor may connect to the second conductive path directly adjacent the second plug contact and may connect to the sixth conductive path directly adjacent the sixth plug contact.

Pursuant to yet additional embodiments of the present invention, RJ-45 communications plugs are provided that have first through eighth conductive paths where the fourth and fifth conductive paths are part of a first differential transmission line, the first and second conductive paths are part of a second differential transmission line, the third and sixth conductive paths are part of a third differential transmission line, and the seventh and eighth conductive paths are part of a fourth differential transmission line. The plugs further have first through eighth plug blades that are electrically connected to the respective first through eighth conductive paths, where the first through eighth plug blades aligned in a row in numerical order. A differential-to-common mode crosstalk cancellation circuit is provided that substantially cancels common mode crosstalk that is injected within the plug from the third differential transmission line onto the second differential transmission line when the third differential transmission line is excited differentially. Additionally, the third differential transmission line is configured to inject differential crosstalk onto the second differential transmission line when the third differential transmission line is excited differentially.

In some embodiments, the amount of differential crosstalk injected from the third transmission line onto the second differential transmission line when the third differential transmission line is excited by a differential signal may be an industry standards specified amount of offending crosstalk. The differential-to-common mode crosstalk cancellation circuit may comprise a first reactive circuit between the second conductive path and the sixth conductive path, and a second reactive circuit between the first conductive path and the sixth conductive path. The first reactive circuit may be a first capacitor on a printed circuit board and the second reactive circuit may be a second capacitor on the printed circuit board. In other embodiments, the first reactive circuit may be a first inductive coupling section on a printed circuit board between the second conductive path and the sixth conductive path, and the second reactive circuit may be a second inductive coupling section on the printed circuit board between the first conductive path and the sixth conductive path.

In some embodiments, the differential-to-common mode crosstalk cancellation circuit includes a third reactive circuit between the second conductive path and the third conductive path. The differential crosstalk injected onto the second transmission line by the third differential transmission line when the third differential transmission line is excited differentially is greater than twice amount of coupling between the second plug blade and the third plug blade minus twice the amount of coupling between the first plug blade and the third plug blade. In other embodiments, the differential-to-common mode crosstalk cancellation circuit includes a third reactive circuit between the first conductive path and the third conductive path. In these embodiments, the differential crosstalk injected onto the second transmission line by the third differential transmission line when the third differential transmission line is excited differentially may be less than twice amount of coupling between the second plug blade and the third plug blade minus twice the amount of coupling between the first plug blade and the third plug blade. The differential-to-common mode crosstalk cancellation circuit may substantially cancel the common mode crosstalk that is injected within the plug from the second differential transmission line onto the third differential transmission line when the second differential transmission line is excited differentially.

Pursuant to even further embodiments of the present invention, RJ-45 communications plugs are provided that have first through eighth conductive paths where the fourth and fifth conductive paths are part of a first differential transmission line, the first and second conductive paths are part of a second differential transmission line, the third and sixth conductive paths are part of a third differential transmission line, and the seventh and eighth conductive paths are part of a fourth differential transmission line. The first, third, fifth and seventh conductive paths are tip conductive paths and the second, fourth, sixth and eighth conductive paths are ring conductive paths. These plugs further have first through eighth plug blades that are electrically connected to the respective first through eighth conductive paths, the first through eighth plug blades aligned in a row in numerical order. An offending crosstalk circuit that is separate from the plug blades is provided that injects crosstalk between the second and third differential transmission lines, where the offending crosstalk circuit is between a ring conductive path and a tip conductive path. Additionally, a differential-to-common mode crosstalk cancellation circuit is provided that is electrically connected between the second differential transmission line and the third differential transmission line.

In some embodiments, the differential-to-common mode crosstalk cancellation circuit substantially cancels common mode crosstalk that is injected within the plug from the third differential transmission line to the second differential transmission line when the third differential transmission line is excited differentially. The differential-to-common mode crosstalk cancellation circuit may include a first reactive circuit between the second conductive path and the sixth conductive path, a second reactive circuit between the first conductive path and the sixth conductive path and a third reactive circuit between the second conductive path and the third conductive path. The first through third reactive circuits may comprise first through third capacitors on a printed circuit board.

Pursuant to further embodiments of the present invention, RJ-45 communications plugs provided that include first through eighth conductive paths that are arranged as first through fourth differential transmission lines. A capacitor and a resistor are electrically coupled in series between two of the first through eighth conductive paths.

DETAILED DESCRIPTION

Figure 1:
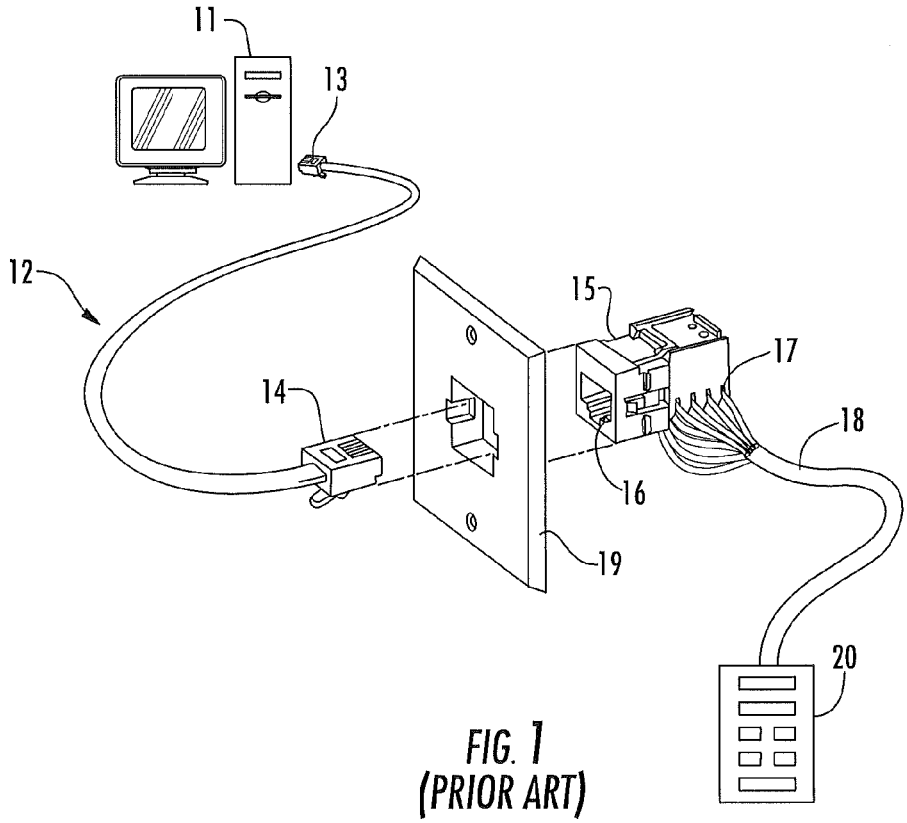
FIG. 1 (PRIOR ART)
FIG. 1 is a simplified schematic diagram illustrating the use of conventional communications plugs and jacks to interconnect a computer with network equipment.
Figure 2:
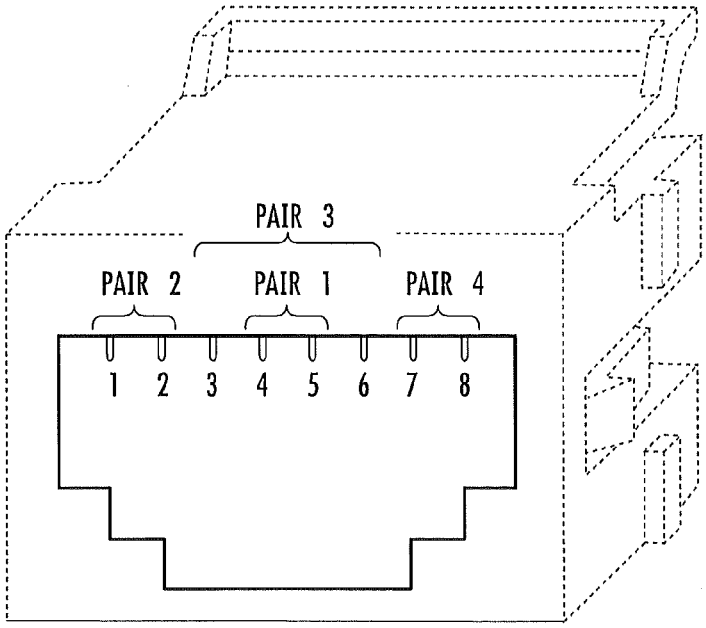
FIG. 2 (PRIOR ART)
FIG. 2 is a schematic diagram illustrating the TIA/EIA 568 type B modular jack contact wiring assignments for a conventional 8-position communications jack as viewed from the front opening of the jack.

The present invention is directed to communications plugs such as RJ-45 plugs. As used herein, the terms "forward" and "front" and derivatives thereof refer to the direction defined by a vector extending from the center of the plug toward the portion of the plug that is first received within a plug aperture of a jack when the plug is mated with a jack. Conversely, the terms "rearward" and "back" and derivatives thereof refer to the direction directly opposite the forward direction. The forward and rearward directions define the longitudinal dimension of the plug. The vectors extending from the center of the plug toward the respective sidewalls of the plug housing defines the transverse (or lateral) dimension of the plug. The transverse dimension is normal to the longitudinal dimension. The vectors extending from the center of the plug toward the respective top and bottom walls of the plug housing (where the top wall of the plug housing is the wall that includes slots that expose the plug blades) defines the vertical dimension of the plug. The vertical dimension of the plug is normal to both the longitudinal and transverse dimensions.

Pursuant to embodiments of the present invention, communications plugs, as well as patch cords that include such communications plugs, are provided that may exhibit reduced levels of differential-to-common mode crosstalk (which is also referred to as "mode conversion"). By reducing the amount of mode conversion that occurs in a communications plug, the need to compensate for such mode conversion in a mating communications jack may be reduced. Moreover, all other factors equal, it may be more efficient to reduce such common mode crosstalk in the plug rather than having to cancel it in the mating jack, since typically most offending crosstalk is generated in the plug and attempting to cancel it in mating jack is subject to the limitations imposed by the transmission delay between the offending and compensating crosstalk. The plugs according to some embodiments of the present invention may substantially cancel the differential-to-common mode crosstalk that arises between selected of the differential transmission lines in the communications plug, while still providing any industry standardized amounts of differential-to-differential crosstalk between these differential transmission lines.

In some embodiments, the communications plug may comprise an RJ-45 plug. The RJ-45 plug may have a printed circuit board that includes first through eighth conductive paths and first through eighth plug blades that are mounted on the printed circuit board and connected to the respective first through eighth conductive paths. The eight conductive paths and plug blades may be arranged as the four differential transmission lines with the conductive paths numbered pursuant to the TIA/EIA 568 type B configuration. The third and sixth conductive paths (i.e., the third differential transmission line) may form an expanded loop on the printed circuit board in order to cancel differential-to-common mode crosstalk that arises between (1) the plug blades of the second and third differential transmission lines and/or (2) the plug blades of the third and fourth differential transmission lines. This expanded loop may substantially cancel the common mode crosstalk injected by the third plug blade onto the first and second plug blades and by the fourth plug blade onto the seventh and eighth plug blades.

In some embodiments, a first portion of the first conductive path and a first portion of the second conductive path may be routed as a transmission line, and a first portion of the sixth conductive path may be routed between the first portion of the first conductive path and the first portion of the second conductive path. The first portion of the sixth conductive path may be configured to couple substantially equal amounts of energy onto the first portion of the first conductive path and the first portion of the second conductive path when a signal is incident on the sixth conductive path. A first portion of the seventh conductive path and a first portion of the eighth conductive path may similarly be routed as a transmission line, and a first portion of the third conductive path may be routed between the first portion of the seventh conductive path and the first portion of the eighth conductive path.

Pursuant to further embodiments of the present invention, communications plugs are provided that include eight plug blades and a printed circuit board that has eight conductive paths that are electrically connected to respective ones of the eight plug blades. The plug blades and the conductive paths may be arranged and numbered pursuant to the TIA/EIA 568 type B configuration. The plug may further include a first crosstalk injection circuit between the second conductive path and the sixth conductive path and a second crosstalk injection circuit between the first conductive path and the sixth conductive path. In some embodiments, the plug may further include a third crosstalk injection circuit between the third conductive path and either the first conductive path or the second conductive path.

The first and second crosstalk injection circuits (and the third crosstalk injection circuit, if provided) may substantially cancel the differential-to-common mode crosstalk injected from the third differential pair onto the second differential pair. The crosstalk injection circuits may comprise, for example, capacitors that are implemented on the printed circuit board.

Pursuant to still further embodiments of the present invention, communications plugs are provided that include first through fourth differential transmission lines. These plugs further include a differential-to-common mode crosstalk cancellation circuit that substantially cancels differential-to-common mode crosstalk that is injected within the plug from the third differential transmission line onto the second differential transmission line. Moreover, the third differential transmission line in these plugs is configured to inject differential-to-differential crosstalk onto the second transmission line.

Patch cords are also provided that include the above-described communications plugs.

Embodiments of the present invention will now be discussed in greater detail with reference to the drawings.

As discussed above, differential-to-common mode crosstalk may be injected from a first differential transmission line to a second differential transmission line in a communications connector such as a modular plug or jack (e.g., from pair 3 to pair 2 and/or to pair 4 in an RJ-45 jack). This differential-to-common mode crosstalk may give rise to alien crosstalk that may degrade the performance of other channels in the communications system in which the connectors are used. The prior art has suggested at least two solutions to the above-described problem of differential-to-common mode crosstalk. In the first solution, the differential-to-common mode crosstalk that is generated in the plug of a mated plug-jack connection and in the plug-jack mating area of the jack is compensated for in the jack. This approach is illustrated in U.S. Pat. No. 5,967,853, which is discussed in greater detail herein, and in U.S. Pat. No. 7,204,722 ("the '722 patent"), which discloses including a crossover in the contact wires of pair 3 in order to cancel such differential-to-common mode crosstalk. In the second solution, an expanded loop on the conductors of pair 3 is provided in an otherwise conventional RJ-45 plug. This approach is illustrated in U.S. Pat. No. 7,220,149 ("the '149 patent"). As explained in the '149 patent, both the plug blades and conductors of pair 3 in most conventional plugs are spatially unbalanced relative to the outside pairs 2 and 4, particularly in the plug blades and the region approaching the blades. The '149 patent discloses providing an expanded loop in the conductors of pair 3 that corrects for the spatial imbalance between (a) pairs 2 and 3 and (b) pairs 3 and 4 caused by the positions of the blades and conductors in a conventional plug.

Figure 3:
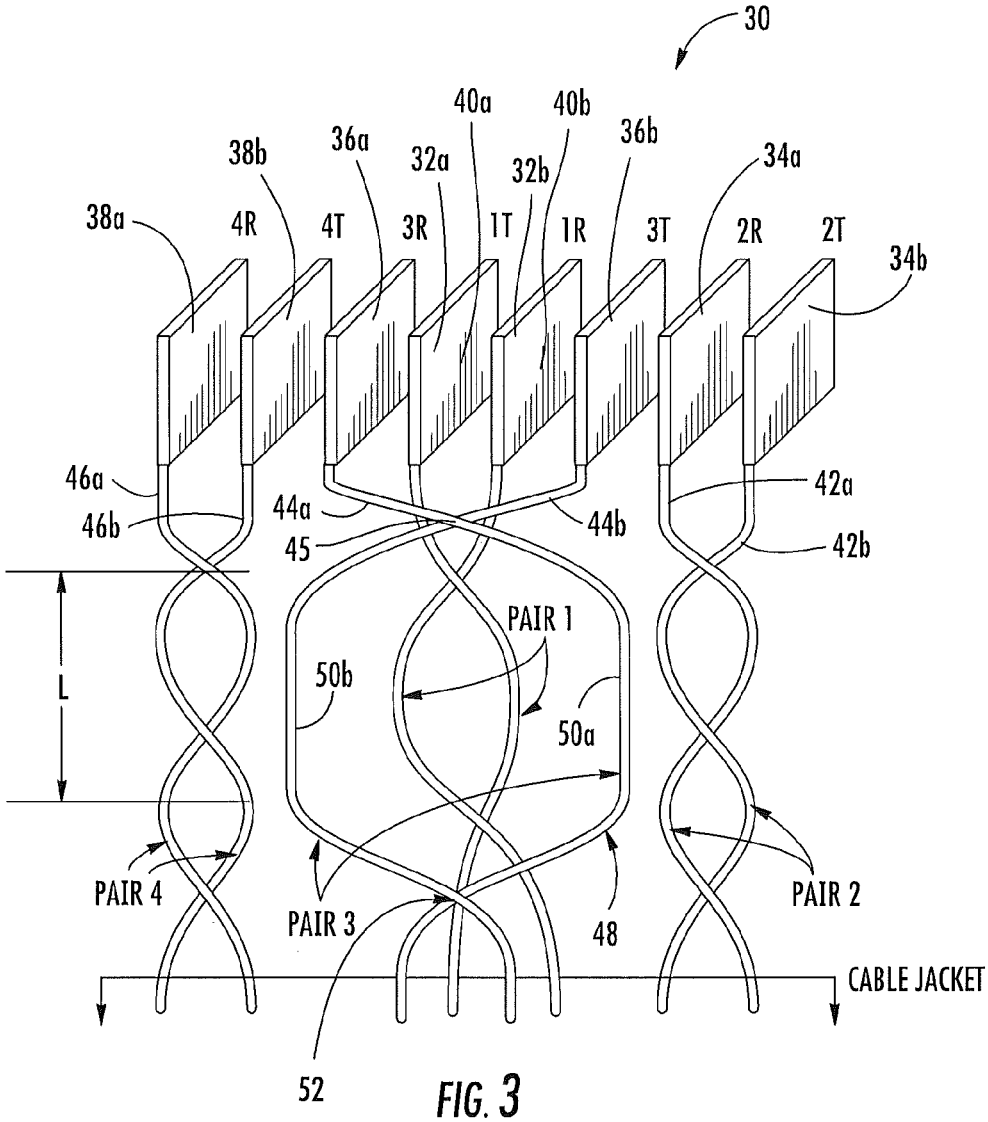
FIG. 3 (PRIOR ART)
FIG. 3 is a stylized partial perspective view of blades and conductors of a prior art communications plug.

FIG. 3 is a stylized partial perspective view of blades and conductors of the prior art plug 30 disclosed in the '149 patent as a solution to the problem of mode conversion.

As shown in FIG. 3, the plug 30 includes eight blades 32*a*, 32*b*, 34*a*, 34*b*, 36*a*, 36*b*, 38*a*, 38*b* and eight conductors 40*a*, 40*b*, 42*a*, 42*b*, 44*a*, 44*b*, 46*a*, 46*b* that are twisted into pairs and attached to the blades in the TIA/EIA 568 B configuration pairings. The conductors 44*a*, 44*b* of pair 3 are arranged such that, after a first crossover point 45 adjacent the blade region, the conductors 44*a*, 44*b* form an expanded loop 48 that terminates at a second crossover point 52. The expanded loop 48 includes segments 50*a*, 50*b* that are positioned adjacent to conductors 42*a*, 42*b* of pair 2 and conductors 46*a*, 46*b* of pair 4, respectively, and that are spaced apart from conductors 40*a*, 40*b* of pair 1. The expanded loop reduces mode conversion that would otherwise occur between (a) pairs 2 and 3 and (b) pairs 3 and 4.

Figure 4:
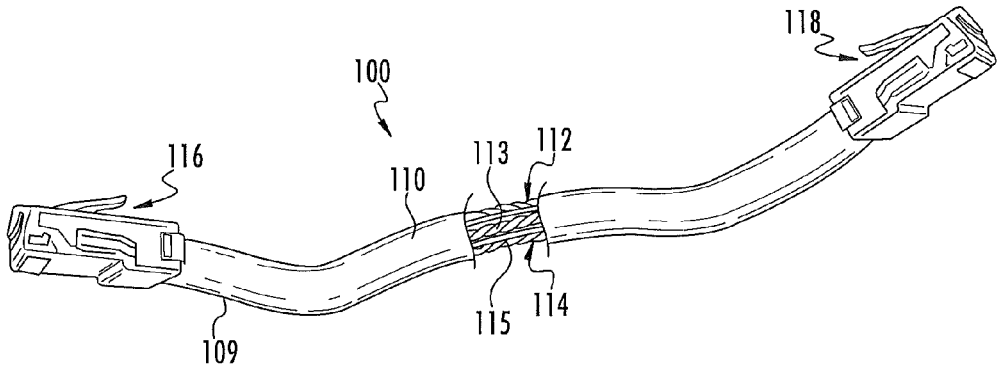
FIG. 4 is a perspective view of a patch cord according to certain embodiments of the present invention.
Figure 5:
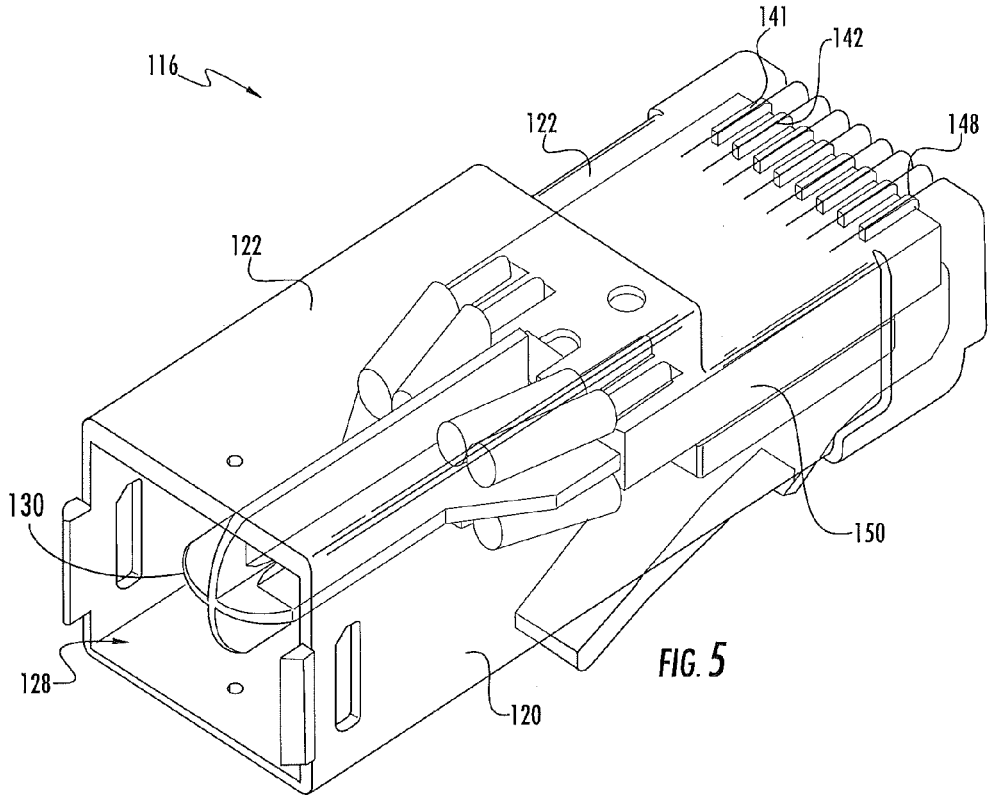
FIG. 5 is a top, rear perspective view of a plug that is included on the patch cord of FIG. 4.
Figure 6:
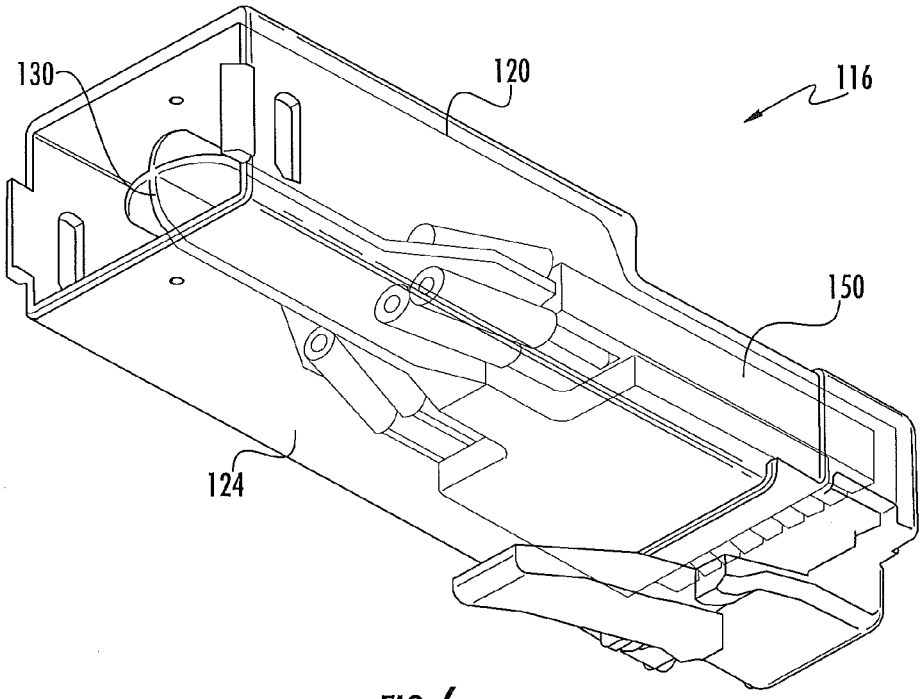
FIG. 6 is a bottom, rear perspective view of the plug of FIG. 5.
Figure 7:
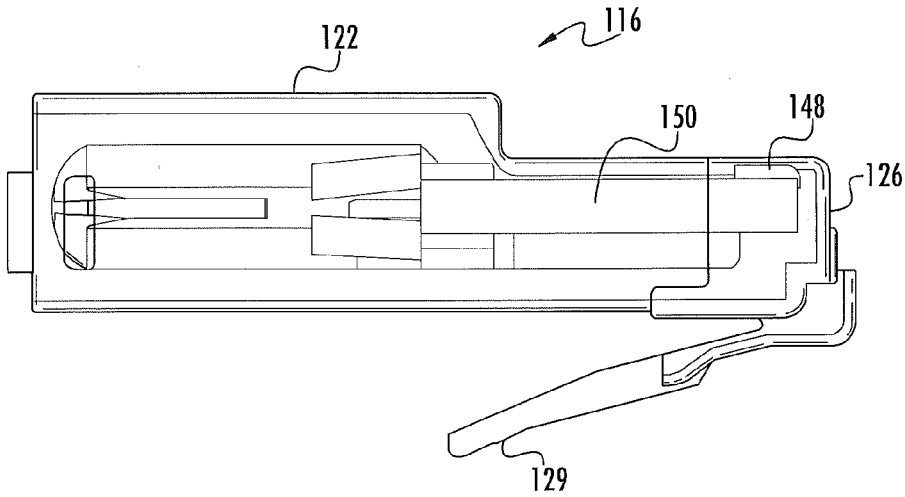
FIG. 7 is a side view of the plug of FIG. 5.
Figure 8:
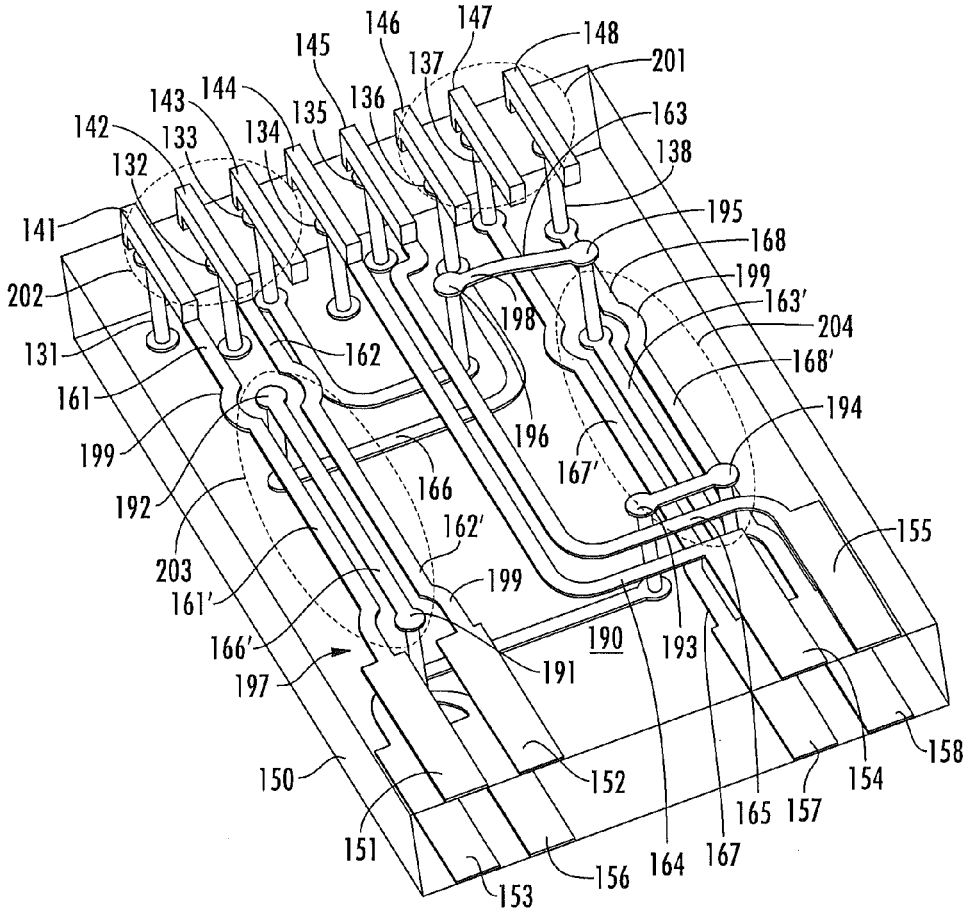
FIG. 8 is a perspective view of the blades and printed circuit board of the plug of FIG. 5.
Figure 9:
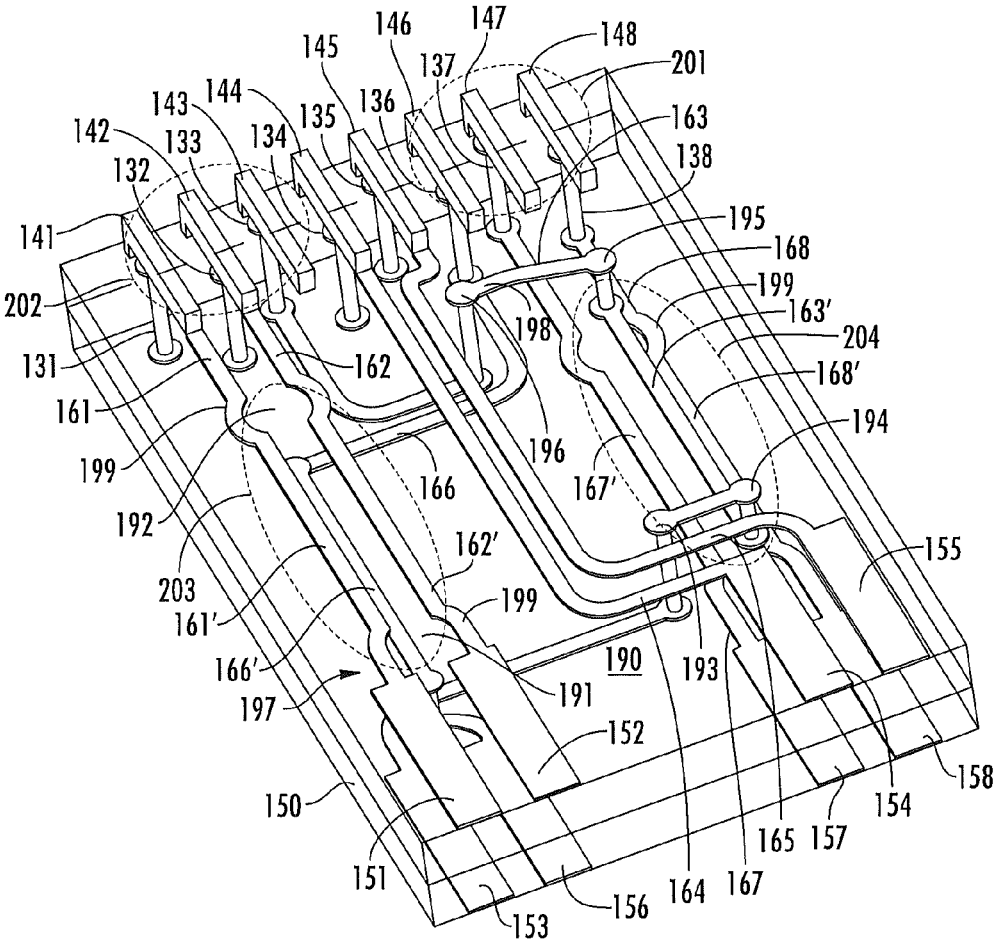
FIG. 9 is a perspective view of an alternative printed circuit board that may be used in the plug of FIG. 5.
Figure 10:
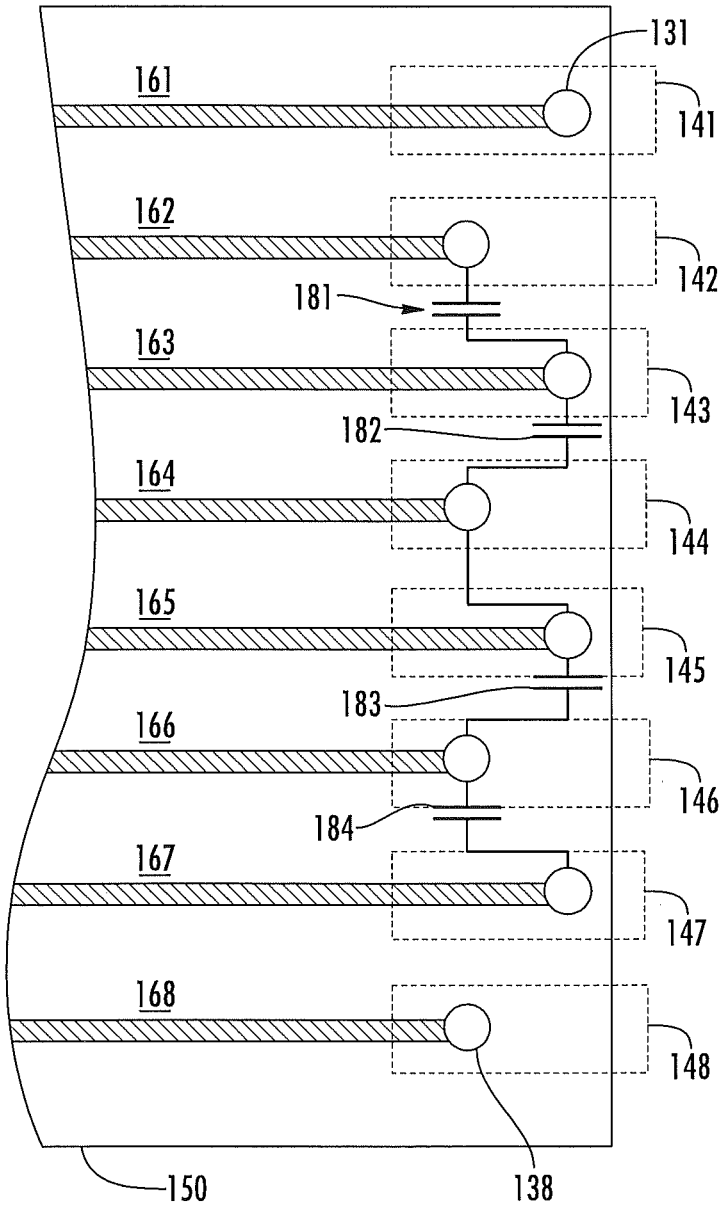
FIG. 10 is a schematic circuit diagram of a front portion of the printed circuit board of FIG. 8 that illustrates four printed circuit board capacitors that may be provided that inject offending crosstalk between various of the plug blades that are mounted on the printed circuit board.

FIGS. 4-10 illustrate a patch cord 100 and various components thereof according to certain embodiments of the present invention. In particular, FIG. 4 is a perspective view of the patch cord 100. FIG. 5 is a top-rear perspective view of a plug 116 that is included on the patch cord 100 of FIG. 4. FIG. 6 is a bottom-rear perspective view of the plug 116. FIG. 7 is a side view of the plug 116. FIG. 8 is a perspective view of the plug contacts 141-148 and a printed circuit board 150 of plug the 116 of FIGS. 5-7. FIG. 9 is a perspective view of an alternative printed circuit board 150' that may be used in the plug FIG. 5. Finally, FIG. 10 is a schematic circuit diagram of a front portion of the printed circuit board 150 that illustrates four printed circuit board capacitors that may be provided that inject offending crosstalk between various of the plug blades.

As shown in FIG. 4, the patch cord 100 includes a cable 109 that has eight insulated conductors 101-108 enclosed in a jacket 110 (the conductors 101-108 are not individually numbered in FIG. 4, and conductors 104 and 105 are not visible in FIG. 4). The insulated conductors 101-108 may be arranged as four twisted pairs of conductors, with conductors 104 and 105 twisted together to form twisted pair 111 (pair 111 is not visible in FIG. 4), conductors 101 and 102 twisted together to form twisted pair 112, conductors 103 and 106 twisted together to form twisted pair 113, and conductors 107 and 108 twisted together to form twisted pair 114. Each twisted pair 111-114 may carry a differential signal. A separator 115 such as a tape separator or a cruciform separator may be provided that separates one or more of the twisted pairs 111-114 from one or more of the other twisted pairs 111-114. A first plug 116 is attached to a first end of the cable 109 and a second plug 118 is attached to the second end of the cable 109 to form the patch cord 100.

FIGS. 5-7 are enlarged views that illustrate the first plug 116 of the patch cord 100. A rear cap of the plug housing and various wire grooming and wire retention mechanisms are omitted to simplify these drawings. As shown in FIGS. 5-7, the communications plug 116 includes a housing 120 that has a bi-level top face 122, a bottom face 124, a front face 126, and a rear opening 128 that receives a rear cap (not shown). A plug latch 129 extends from the bottom face 124. The top and front faces 122, 126 of the housing 120 include a plurality of longitudinally extending slots. The communications cable 109 (see FIG. 4) is received through the rear opening 128. The rear cap (not shown) locks into place over the rear opening 128 of housing 120 and includes an aperture that receives the communications cable 109.

As is also shown in FIGS. 5-7, the communications plug 116 further includes a printed circuit board 150 which is disposed within the housing 120, and a plurality of plug contacts 141-148 in the form of low profile plug blades that are mounted at the forward edge of the printed circuit board 150. The top and front surfaces of the plug blades 141-148 are exposed through the slots in the top face 122 and front face 126 of the housing 120. The housing 120 may be made of an insulative plastic material that has suitable electrical breakdown resistance and flammability properties such as, for example, polycarbonate, ABS, ABS/polycarbonate blend or other dielectric molded materials.

The conductors 101-108 may be maintained in pairs within the plug 116. A cruciform separator 130 may be included in the rear portion of the housing 120 that separates each pair 111-114 from the other pairs 111-114 in the cable 109 to reduce crosstalk in the plug 116. The conductors 101-108 of each pair 111-114 may be maintained as a twisted pair all of the way from the rear opening 128 of plug 116 up to the back edge of the printed circuit board 150.

FIG. 8 is a perspective top view of the printed circuit board 150 and the plug blades 141-148 that illustrate these structures in greater detail. FIG. 8 also shows how the conductors 101-108 of communications cable 109 may be electrically connected to the respective plug blades 141-148 through the printed circuit board 150. The printed circuit board 150 may comprise, for example, a conventional printed circuit board, a specialized printed circuit board (e.g., a flexible printed circuit board) or any other appropriate type of wiring board. In the depicted embodiment, the printed circuit board 150 comprises a conventional multi-layer printed circuit board.

As shown in FIG. 8, the printed circuit board 150 includes four plated pads 151, 152, 154, 155 on a top surface thereof and four plated pads 153, 156-158 on a bottom surface thereof. The insulation is removed from an end portion of each of the conductors 101-108 (see FIGS. 4-6) and the metal (e.g., copper) core of each conductor 101-108 may be soldered, welded or otherwise attached to a respective one of the plated pads 151-158. It will be appreciated that other techniques may be used for terminating the conductors 101-108 to the printed circuit board 150. It will also be appreciated that in other embodiments different numbers of the conductors 101-108 may be mounted on the top and bottom surfaces of the printed circuit board 150 (e.g., all eight on one surface, six on one surface and two on another surface, etc.).

The plug blades 141-148 are configured to make mechanical and electrical contact with respective contacts, such as, for example, spring jackwire contacts, of a mating communications jack. Each of the eight plug blades 141-148 is mounted at the front portion of the printed circuit board 150. The plug blades 141-148 may be substantially aligned in a side-by-side relationship along the transverse dimension. Each of the plug blades 141-148 includes a first section that extends forwardly (longitudinally) along a top surface of the printed circuit board 150, a transition section that curves through an angle of approximately ninety degrees and a second section that extends downwardly from the first section along a portion of the front edge of the printed circuit board 150. The portion of each plug blade 141-148 that is in physical contact with a contact structure (e.g., a jackwire contact) of a mating jack during normal operation is referred to herein as the "plug-jack mating point" of the plug contact 141-148. The plug contacts 141-148 are also referred to herein as "plug blades."

In some embodiments, each of the plug blades 141-148 may comprise, for example, an elongated metal strip having a length of approximately 140 mils, a width of approximately 20 mils and a height (i.e., a thickness) of approximately 20 mils. Each plug blade 141-148 may include a projection that extends downwardly from the bottom surface of the first section of the plug blade. The printed circuit board 150 includes eight metal-plated vias 131-138 that are arranged in two rows along the front edge thereof. The downwardly-extending projections of each plug blade 141-148 is received within a respective one of the metal-plated vias 131-138 where it may be press-fit, welded or soldered into place to mount the plug blades 141-148 on the printed circuit board 150. In some embodiments, the projections may be omitted and the plug blades 141-148 may be soldered or welded directly onto conductive structures (e.g., pads) that are deposited on top of the respective vias 131-138.

Turning again to FIG. 8 it can be seen that a plurality of conductive paths 161-168 are provided on the top and bottom surfaces of the printed circuit board 150. Each of these conductive paths 161-168 electrically connects one of the plated pads 151-158 to a respective one of the metal-plated vias 131-138 so as to provide a conductive path between each of the conductors 101-108 that are terminated onto the plated pads 151-158 and a respective one of the plug blades 141-148 that are mounted in the metal-plated vias 131-138. Each conductive path 161-168 may comprise, for example, one or more conductive traces that are provided on one or more layers of the printed circuit board 150. When a conductive path 161-168 includes conductive traces that are on multiple layers of the printed circuit board 150, metal-filled through holes (or other layer-transferring structures known to those skilled in this art) may be provided that provide an electrical connection between the conductive traces on different layers of the printed circuit board 150.

A total of four differential transmission lines 171-174 are provided through the plug 116. The first differential transmission line 171 includes the end portions of conductors 104 and 105, the plated pads 154 and 155, the conductive paths 164 and 165, and the plug blades 144 and 145. The second differential transmission line 172 includes the end portions of conductors 101 and 102, the plated pads 151 and 152, the conductive paths 161 and 162, and the plug blades 141 and 142. The third differential transmission line 173 includes the end portions of conductors 103 and 106, the plated pads 153 and 156, the conductive paths 163 and 166, and the plug blades 143 and 146. The fourth differential transmission line 174 includes the end portions of conductors 107 and 108, the plated pads 157 and 158, the conductive paths 167 and 168, and the plug blades 147 and 148. As shown in FIG. 8, the conductive paths that form each the differential transmission lines 171, 172 and 174 are generally run together, side-by-side, on the printed circuit board 150, which may provide improved impedance matching.

In contrast, the conductive paths 163 and 166 that form the third differential transmission line 173 do not run in a side-by-side fashion across the printed circuit board 150. Instead, adjacent the conductive pad 156, conductive path 166 transitions from the bottom surface of printed circuit board 150 to the top surface at a first conductive via 191. The top of a first conductive via 191 is positioned between conductive paths 161 and 162, and conductive path 166 runs between conductive paths 161 and 162 from the top of the first conductive via 191 to the top of a second conductive via 192. Conductive path 166 then transitions at the second conductive via 192 to the bottom surface of printed circuit board 150, where it is routed to connect to the conductive via 136 that is used to mount plug blade 146 onto the printed circuit board 150.

In a similar fashion, conductive path 163 is routed from conductive pad 153 to the other side of printed circuit board 150, where it transitions from the bottom surface of the printed circuit board 150 to the top surface at a third conductive via 193. Conductive path 163 then travels a short distance on the top surface of printed circuit board 150 to a fourth conductive via 194 that transitions conductive path 163 back to the bottom surface of the printed circuit board 150. The bottom of the fourth conductive via 194 is positioned between conductive paths 167 and 168, and conductive path 163 runs between conductive paths 167 and 168 from the bottom of the fourth conductive via 194 to the bottom of a fifth conductive via 195. Conductive path 163 then transitions at the fifth conductive via 195 to the top surface of printed circuit board 150, where is routed to connect to a sixth conductive via 196. Conductive path 163 then transition at the sixth conductive via 196 back to the bottom surface of the printed circuit board 150 where it is routed to the conductive via 133 that is used to mount plug blade 143 onto the printed circuit board 150. Conductive vias 193-196 are merely used to transition conductive path 163 between the top and bottom surfaces of the printed circuit board 150 so that conductive path 163 may cross other of the conductive paths 161-168 without short-circuiting.

As shown in FIG. 8, the above-described routing of conductive paths 163 and 166 forms a loop 190 on the printed circuit board 150. In particular, conductive paths 163 and 166 cross over each other at two crossover points 197, 198, thereby, in effect, carrying over the twist that is present in conductors 103 and 106 onto the printed circuit board 150. Moreover, instead of maintaining a tight twist as is the case in the conductors 103, 106, conductive paths 163 and 166 spread far apart on the printed circuit board 150 so that the loop 190 is an "expanded loop" 190.

As is apparent from FIG. 8, plug blade 146 will couple more heavily with plug blades 147 and 148 than will plug blade 143, forming a first unbalanced coupling region 201. As a result of the unbalanced coupling in region 201, when a signal is transmitted over differential transmission line 173, unequal amounts of signal energy will flow from conductors 103 and 106 of differential transmission line 173 onto differential transmission line 174 in the plug blade region of plug 116, thereby injecting differential-to-common mode crosstalk from differential transmission line 173 onto differential transmission line 174. In a similar fashion, plug blade 143 will couple more heavily with plug blades 141 and 142 than will plug blade 146, forming a second unbalanced coupling region 202. As a result of the unbalanced coupling in region 202, when a signal is transmitted over differential transmission line 173, unequal amounts of signal energy will flow from conductors 103 and 106 of differential transmission line 173 onto differential transmission line 172 in the plug blade region of plug 116, thereby injecting differential-to-common mode crosstalk from differential transmission line 173 onto differential transmission line 172. As noted above, this differential-to-common mode crosstalk may generate alien crosstalk in other channels of the communications system that includes plug 116, degrading the performance of those other communications channels.

The expanded loop 190 is provided in differential transmission line 173 to reduce or cancel the differential-to-common mode crosstalk that is injected from differential transmission line 173 onto differential transmission lines 172 and 174. In particular, by routing a segment 166' of conductive path 166 so that it runs between segments 161', 162' of differential transmission line 172, while corresponding segment 163' of conductive path 163 is maintained far away from segments 161', 162' of differential transmission line 172, a third unbalanced coupling region 203 is formed in plug 116. This third unbalanced coupling region 203 injects differential-to-common mode crosstalk from differential transmission line 173 onto differential transmission line 172 that has the opposite polarity of the differential-to-common mode crosstalk that is injected in region 202, and which hence acts to cancel the differential-to-common mode crosstalk that is injected in region 202. Similarly, by routing a segment 163' of conductive path 163 so that it runs between segments 167', 168' of differential transmission line 174, while corresponding segment 166' of conductive path 166 is maintained far away from segments 167', 168' of differential transmission line 174, a fourth unbalanced coupling region 204 is formed in plug 116. This fourth unbalanced coupling region 204 injects differential-to-common mode crosstalk from differential transmission line 173 onto differential transmission line 174 that has the opposite polarity of the differential-to-common mode crosstalk that is injected in region 201, and which hence acts to cancel the differential-to-common mode crosstalk that is injected in region 201.

As shown in FIG. 8, the segments 161', 162' of differential transmission line 172 that couple with segment 166' of conductive path 166 are not twisted (as is the case with the plug design disclosed in the aforementioned '149 patent), but instead comprise a pair of generally parallel trace segments 161', 162' on the printed circuit board 150. In order to have generally equal coupling between segment 166' of conductive path 166 and the segments 161', 162' of differential transmission line 172, segment 166' is routed between and parallel to the segments 161', 162' and is generally equidistant from each of segments 161' and 162' in the region 203 where the three conductive trace segments 161', 162' 166' are routed generally in parallel to each other on the printed circuit board 150. In like fashion, the segments 167', 168' of differential transmission line 174 that couple with segment 163' of conductive path 163 are not twisted, but instead comprise a pair of generally parallel trace segments 167', 168' on the printed circuit board 150. In order to have generally equal coupling between segment 163' of conductive path 163 and the segments 167', 168' of differential transmission line 174, segment 163' is routed between and parallel to the segments 167', 168' and is generally equidistant from each of segments 167' and 168' in the region 204 where the three conductive trace segments 166', 167', 168' are routed generally in parallel to each other on the printed circuit board 150.

As is also shown in FIG. 8, in the region 203 where conductive trace segments 161', 162' and 166' run generally in parallel, conductive path 162 is closer to differential transmission line 174 than is conductive path 166. This feature results because conductive path 166 is routed between conductive paths 161 and 162. Similarly, in the region 204 where conductive trace segments 167', 168' and 163' run generally in parallel, conductive path 167 is closer to differential transmission line 172 than is conductive path 163. This feature results because conductive path 163 is routed between conductive paths 167 and 168. Once again, this is in contrast to the plug design of the '149 patent where the expanded loop on pair 3 stays between the outside twisted pairs.

In the particular embodiment depicted in FIG. 8, segments 161', 162' are sufficiently close together that there is not sufficient room for the first and second conductive vias 191, 192 therebetween without the danger of a short circuit and/or undesired effects on the impedance of differential transmission line 172 from the vias 191, 192. Accordingly, conductive paths 161 and 162 include bends/arcuations 199 where the conductive paths 161, 162 split farther apart to accommodate the conductive vias 191, 192. Similar bends/arcuations 199 are provided in conductive paths 167, 168 to accommodate the conductive vias 194, 195.

While in the embodiment of FIG. 8, the segment 166' of conductive path 166 is routed between segments 161', 162' of differential transmission line 172 on the same side of the printed circuit board 150 (and segment 163' of conductive path 163 is likewise routed between segments 167', 168' of differential transmission line 174 on the same side of the printed circuit board 150), it will be appreciated that embodiments of the present invention are not limited to this configuration. For example, FIG. 9 illustrates an alternative printed circuit board 150' in which segment 166' of conductive path 166 is routed between segments 161', 162' of differential transmission line 172 on a different layer of the printed circuit board 150' (i.e., segments 161', 162' are on a first layer of printed circuit board 150', while segment 166' is on a second different layer of printed circuit board 150'). In some embodiments, the first layer could be, for example, a top layer and the second layer could be a bottom layer, while in other embodiments the second layer could be an intermediate layer. Similarly, segment 163' of conductive path 163 is routed between segments 167', 168' of differential transmission line 174 but on a different layer of the printed circuit board 150' (i.e., segments 167', 168' are on the bottom layer of printed circuit board 150', while segment 166' is on an intermediate layer or on the top layer of printed circuit board 150'). Such a design may be used where the dielectric layer(s) of printed circuit board 150' are sufficiently thin such that sufficient coupling may be achieved between traces that run in overlapping or near overlapping fashion on the top and bottom sides of the printed circuit board 150'. Segment 166' of conductive path 166 may be equidistant from segments 161', 162' of differential transmission line 172, and segment 163' of conductive path 163 may be equidistant from segments 167', 168' of differential transmission line 174. The printed circuit board 150' may be a conventional printed circuit board or a flexible printed circuit board.

As noted above, in some embodiments, segments 163' and/or 166' may be routed on an intermediate layer of the printed circuit board 150'. In order to ensure that intermediate printed circuit board layers can manage the current flow without excessive heating, the segments 163' and/or 166' may be widened to reduce the current density per unit volume in these conductive traces. Notably, the widened trace segments 166' and 163' may exhibit increased capacitive coupling with the segments 161', 162' of differential transmission line 172 and the 167', 168' of differential transmission line 174, respectively. Such increased capacitive coupling may be disadvantageous in some cases, as it may be more effective to locate as much of the capacitive coupling as possible very near the plug-jack mating point. Routing segments 166' and 163' between the segments 161', 162' of differential transmission line 172 and the 167', 168' of differential transmission line 174, respectively, may also negatively impact the return loss on differential transmission lines 172 and 174.

FIGS. 9A-9D schematically illustrate additional configurations for the coupling region 203. These configurations may exhibit reduced capacitive coupling and/or reduced impact on the return loss on differential transmission line 172. In the plan views of FIGS. 9B-9D, the solid traces are conductive traces that are on a top layer of the printed circuit board and the cross-hatched traces are traces that are on an intermediate or bottom layer of the printed circuit board. It will be appreciated that these designs may also be implemented on conductive segments 163', 167' and 168' to implement coupling region 204.

Figure 9A:
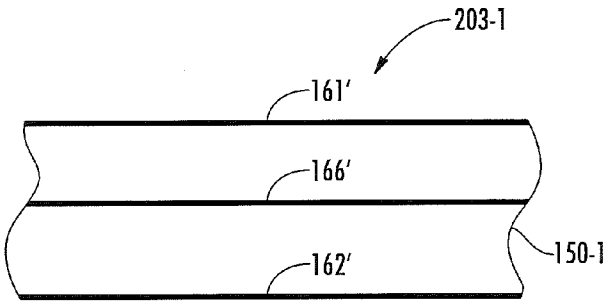
FIGS. 9A-9D are schematic illustrations of portions of additional alternative printed circuit boards that may be used in the plug of FIG. 5.

Turning first to FIG. 9A, another implementation of the coupling region 203 is illustrated under reference numeral 203-1. FIG. 9A is a schematic cross-sectional view of a portion of the printed circuit board 150-1. In the embodiment of FIG. 9A, segments 161' and 162' are routed in a vertically stacked arrangement on the top and bottom sides of the printed circuit board 150-1 (which typically would be implemented as a flexible printed circuit board). Segment 166' is routed on an intermediate layer of the printed circuit board 150-1' between segments 161' and 162'. Segment 166' may be equidistant from segments 161' and 162', and may be generally vertically stacked with segments 161' and 162'. Segment 166' may be wider than segments 161' and 162' in order to reduce the current density in segment 166' since segment 166' is implemented in an intermediate layer of the printed circuit board 150-1.

Figure 9B:
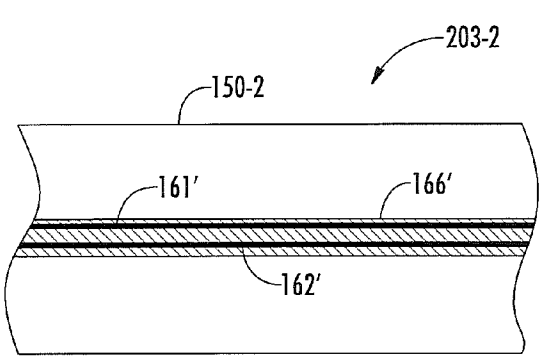

Turning next to FIG. 9B, another implementation 203-2 of the coupling region 203 is illustrated that is implemented on a flexible printed circuit board 150-2. FIG. 9B is a schematic plan view of a portion of the printed circuit board 150-2. In the embodiment of FIG. 9B, segments 161' and 162' are routed in a side-by-side fashion on a first layer of the printed circuit board 150-2 (e.g., on the top layer). Segment 166' is routed on a different layer of the printed circuit board 150-2 such as an intermediate layer of a bottom layer. Segment 166' is routed to overlap segments 161' and 162', as shown. The centerline of segment 166' may be generally equidistant from the centerlines of segments 161' and 162'. Segment 166' may be wider than segments 161' and 162' in order to reduce the current density in segment 166' if it is implemented in an intermediate layer of the printed circuit board 150-2.

Figure 9C:
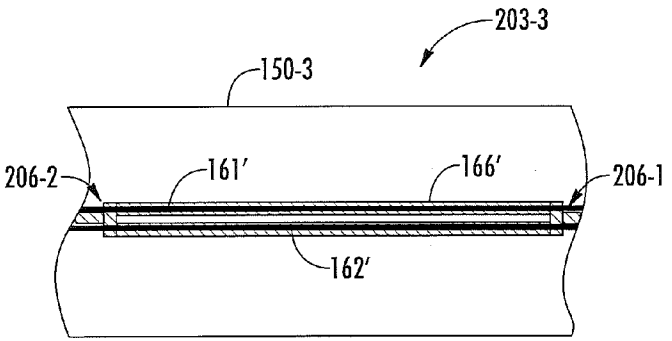

Turning next to FIG. 9C, another implementation 203-3 of the coupling region 203 is illustrated that is implemented on a flexible printed circuit board 150-3. FIG. 9C is a schematic plan view of a portion of the printed circuit board 150-3. In the embodiment of FIG. 9C, segments 161' and 162' are again routed in a side-by-side fashion on a first layer of the printed circuit board 150-3 (e.g., on the top layer). Segment 166' is routed on a different layer of the printed circuit board 150-3 such as an intermediate layer of a bottom layer. In the embodiment of FIG. 9C, segment 166' splits into two separate current paths at a first junction 206-1. Segment 166' then recombines into a single current path at a second junction 206-2. The two current paths for segment 166' that are provided between the junctions 206-1, 206-2 are routed to overlap the respective segments 161', 162', as shown. Thus, segment 161' may be generally vertically stacked with one of the two current paths of segment 166' and segment 162' may be generally vertically stacked with the other of the two current paths of segment 166'. The two current paths of segment 166' may be equidistant from segments 161' and 162'. By splitting the current on segment 166' along two current paths it may be possible to use thinner trace segments, as shown.

Figure 9D:
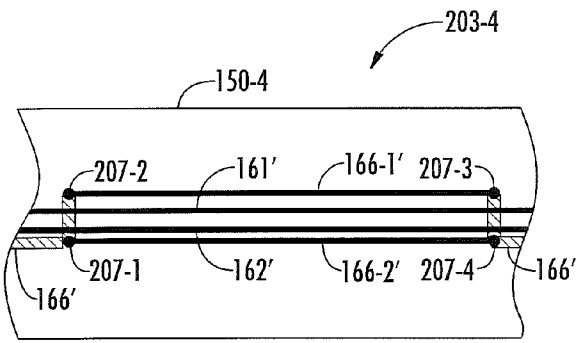

Turning next to FIG. 9D, another implementation 203-4 of the coupling region 203 is illustrated that is implemented on a flexible printed circuit board 150-4. FIG. 9D is a schematic plan view of a portion of the printed circuit board 150-4. In the embodiment of FIG. 9D, segments 161' and 162' are again routed in a side-by-side fashion on a first layer of the printed circuit board 150-4 (e.g., on the top layer). Segment 166' is again split into two separate current paths. In particular, starting at the left hand side of FIG. 9D, it can be seen that segment 166' initially is on a lower layer (e.g., an intermediate layer or bottom layer) of the printed circuit board 150-4 while segments 161' and 162' are on the top layer. A conductive via 207-1 acts as a first junction that splits segment 166' into the two current paths 166-1' and 166-2'. Segment 166-1' extends on the lower layer of printed circuit board 150-4 from the first via 207-1 to a second via 207-2 where it transitions to the top layer of. Section 166-1' then extends on the top layer parallel and immediately adjacent to segment 161' to a third conductive via 207-3. At the base of via 207-3, segment 166-1' then connects to a fourth conductive via 207-4 where segment 166-1' recombines with segment 166-2'. Segment 166-2' extends from the first via 207-1 to the fourth via 207-4 and extends on the top layer parallel and immediately adjacent to segment 162'. Current path 166-1' may be the same distance from segment 161' as is current path 166-2' from segment 162'.

The embodiments of FIGS. 9 and 9B-9D do not interpose any conductive segments between the segments 161' and 162'. This may improve the performance of the transmission line 172. Moreover, the embodiments of FIGS. 9C and 9D may exhibit reduced capacitive coupling between segment 166' and segments 161' and 162', which may also improve performance.

The third and fourth unbalanced coupling regions 203 and 204 may be designed to inject differential-to-common mode crosstalk between differential transmission line 173 and differential transmission lines 172 and 174, respectively, that is sufficient to substantially cancel the differential-to-common mode crosstalk that is injected by differential transmission line 173 onto differential transmission lines 172 and 174 in the plug blade region of plug 116. If it is anticipated that additional differential-to-common mode crosstalk may be injected by differential transmission line 173 onto differential transmission lines 172 and 174 in the leadframe of a mating jack, the amount of differential-to-common mode crosstalk injected by differential transmission line 173 onto differential transmission lines 172 and 174 may be increased so that this additional differential-to-common mode crosstalk is also substantially cancelled by the differential-to-common mode crosstalk that is injected in the third and fourth unbalanced coupling regions 203 and 204. The amount of differential-to-common mode crosstalk that is introduced in the third and fourth unbalanced coupling regions 203 and 204 may be adjusted in a variety of ways including, for example, adjusting the lengths of the coupling segments 161'/162'/166' and 166'/167'/168', adjusting the thickness of these segments, adjusting the separation of these segments, etc.

As noted above, the plug blades 141-148 may comprise "low profile" plug blades that have much smaller facing surface areas. This may significantly reduce the amount of offending crosstalk that is generated between the various differential pair combinations in the plug 116. The terminations of the conductors 101-108 onto the printed circuit board 150 and the routings of the conductive paths 161-168 may also be designed to reduce or minimize the amount of offending crosstalk that is generated between the differential pairs 171-174. As a result, the amount of offending crosstalk that is generated in the plug 116 may be significantly less than the offending crosstalk levels specified in the relevant industry-standards documents. A plurality of offending crosstalk circuits thus may be provided in plug 116, if necessary, that inject additional offending crosstalk between the pairs in order to bring the plug 116 into compliance with these industry standards documents.

The use of low profile plug blades and offending crosstalk circuits may be beneficial, for example, because if everything else is held equal, more effective crosstalk cancellation may generally be achieved if the offending crosstalk and the compensating crosstalk are injected very close to each other in time (as this minimizes the phase shift that occurs between the point(s) where the offending crosstalk is injected and the point(s) where the compensating crosstalk is injected). The plug 116 may be designed to generate low levels of offending crosstalk in the back portion of the plug (i.e., in portions of the plug 116 that are at longer electrical delays from the plug-jack mating regions of the plug blades 141-148), and the offending crosstalk circuits are provided to inject the bulk of the offending crosstalk at very short delays from the plug-jack mating regions of the plug blades 141-148. This may allow for more effective cancellation of the offending crosstalk in a mating jack.

As shown in the circuit diagram of FIG. 10, four offending crosstalk capacitors 181-184 may be provided adjacent the plug blades 141-148 (different numbers of capacitors may be provided in other embodiments). Capacitor 181 injects offending crosstalk between plug blades 142 and 143 (i.e., between differential transmission lines 172 and 173), capacitor 182 injects additional offending crosstalk between plug blades 143 and 144 (i.e., between differential transmission lines 171 and 173), capacitor 183 injects offending crosstalk between plug blades 145 and 146 (i.e., between differential transmission lines 171 and 173), and capacitor 184 injects offending crosstalk between plug blades 146 and 147 (i.e., between differential transmission lines 173 and 174). Each of the four offending crosstalk capacitors 181-184 are configured to inject the offending crosstalk at a location that is very near to the plug-jack mating region of each plug blade 142-147. In particular, the electrodes for each crosstalk capacitor 181-184 connect to the top edges of the conductive vias 132-137 (note that only vias 131 and 138 are numbered in FIG. 10, but each via is clearly pictured in FIG. 10). Thus, the offending crosstalk that is generated by each offending crosstalk capacitor 181-184 is injected at the underside of the plug blades 142-147, directly opposite the plug-jack mating region of the respective plug blades.

Figure 10A:
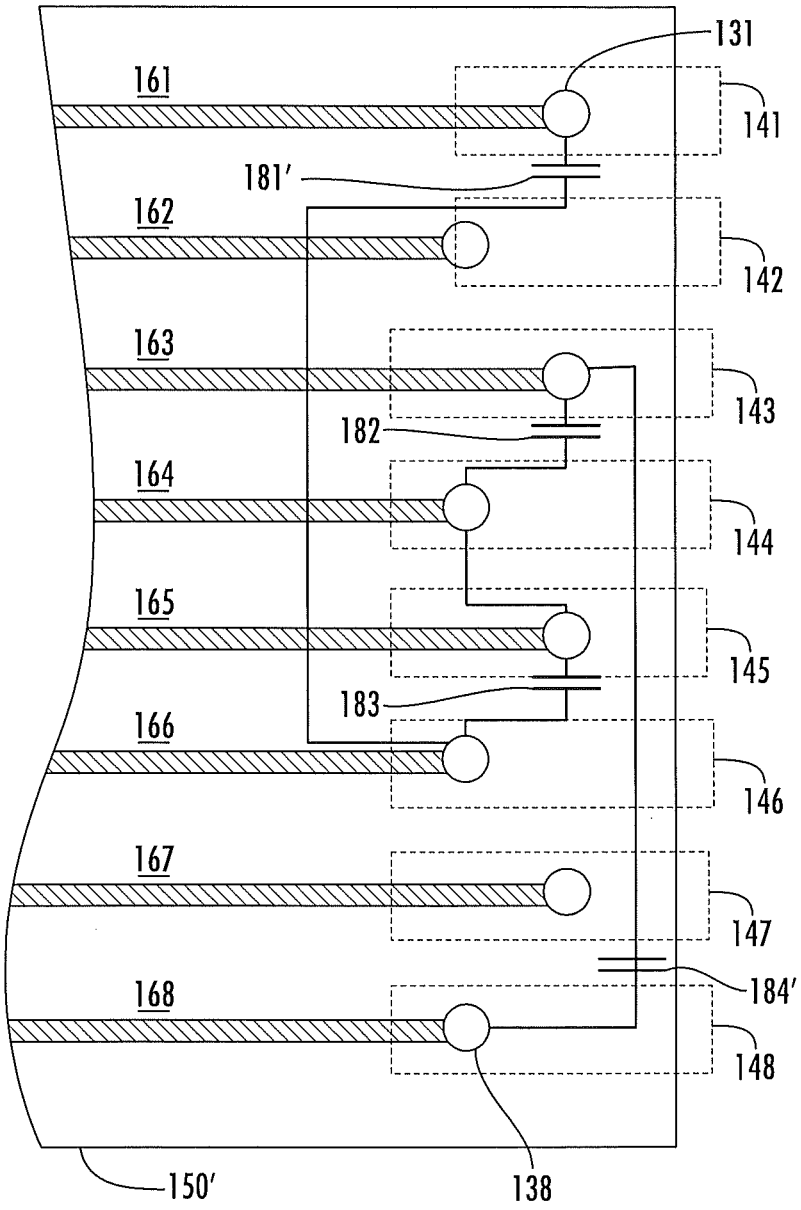
FIG. 10A is a schematic circuit diagram of a front portion of a revised version of the printed circuit board of FIG. 8 according to embodiments of the present invention.

FIG. 10A is a schematic circuit diagram of a portion of a revised version 150' of the printed circuit board 150 of FIG. 8. As shown in FIG. 10A, the printed circuit board 150' includes the offending crosstalk capacitors 182 and 183 that are provided in the embodiment of FIG. 10, but replaces offending crosstalk capacitors 181 and 184 with offending crosstalk capacitors 181' and 184'. Capacitor 181' injects offending crosstalk between plug blades 141 and 146 (i.e., between differential transmission lines 172 and 173), and capacitor 184' injects additional offending crosstalk between plug blades 143 and 148 (i.e., between differential transmission lines 173 and 174). Thus, capacitor 181' injects crosstalk between the same two transmission lines as capacitor 181 of FIG. 10 that has the exact same polarity as the crosstalk injected by capacitor 181 of FIG. 10, and capacitor 184' injects crosstalk between the same two transmission lines as capacitor 184 of FIG. 10 that has the exact same polarity as the crosstalk injected by capacitor 184 of FIG. 10. However, by providing capacitors 181' and 184' that couple between plug blades 141 and 146 and between plug blades 143 and 148, respectively, it may be possible to further reduce mode conversion. As with the embodiment of FIG. 10, offending crosstalk capacitors 181' and 184' are configured to inject the offending crosstalk at locations that are very close to the plug-jack mating region.

Pursuant to further embodiments of the present invention, communications plugs (and related patch cords) are provided that may substantially cancel the differential-to-common mode crosstalk that is injected between various of the differential transmission lines though the plug while maintaining predetermined amounts of differential-to-differential crosstalk between these differential transmission lines. These plugs may be industry standards compliant plugs that exhibit the required amounts of differential-to-differential crosstalk while generating significantly lower levels of differential-to-common mode crosstalk, thereby reducing any need to cancel substantial amounts of differential-to-common mode crosstalk in a mating jack. Before describing these communications plugs, it is helpful to briefly discuss various known schemes for cancelling differential-to-differential and differential-to-common mode crosstalk.

Figure 11:
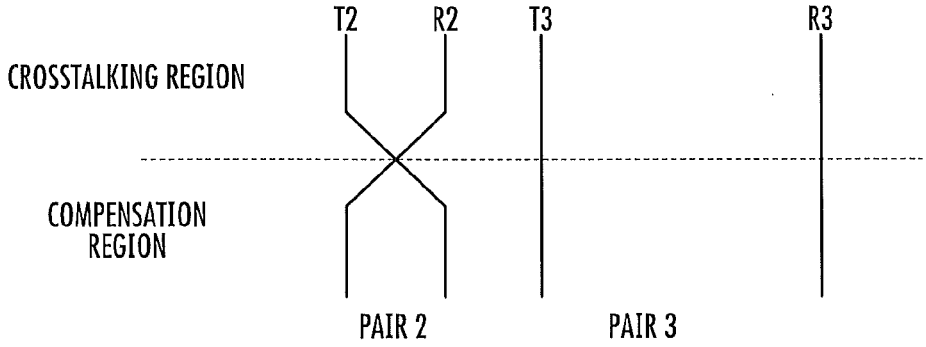
FIG. 11 (PRIOR ART)
FIG. 11 is a schematic diagram of a known crosstalk compensation scheme that compensates for differential-to-differential crosstalk.

In particular, FIG. 11 is a schematic diagram of a known crosstalk compensation scheme that compensates for differential-to-differential crosstalk between pairs 2 and 3 in a four-pair modular mated plug/jack combination that conforms to the TIA/EIA T568-B wiring convention. Referring to FIG. 11, if pair 3 is driven differentially, the differential signal energy that is coupled onto pair 2 may be substantially canceled out (ignoring the effects of delay) by virtue of the crossover in pair 2. Unfortunately, however, coupled common-mode signals on pair 2 are not addressed by the compensation scheme of FIG. 11, as conductor T3 (tip of pair 3) will couple more signal energy onto pair 2 than will conductor R3 (ring of pair 3).

Figure 12:
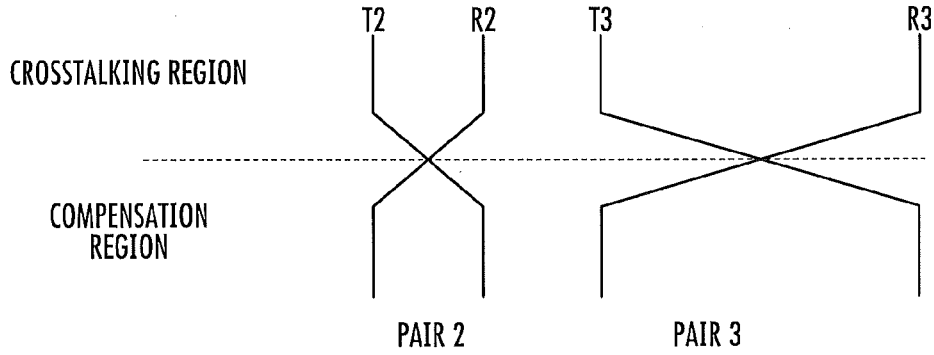
FIG. 12 (PRIOR ART)
FIG. 12 is a schematic diagram of a known crosstalk compensation scheme that compensates for differential-to-common mode crosstalk.

FIG. 12 is a schematic diagram of a known crosstalk compensation scheme that compensates for differential-to-common mode crosstalk. As shown in FIG. 12, a crossover is added to the conductors of pair 3 (T3, R3), so that the differential-to-common mode crosstalk that is injected onto pair 2 in the "crosstalking region" may be substantially cancelled by the opposite polarity differential-to-common mode crosstalk that is injected from pair 3 onto pair 2 in the "compensation region." While the compensation scheme of FIG. 12 may effectively cancel out any coupled common-mode signals, unfortunately it does not address differential-to-differential crosstalk.

Figure 13A:
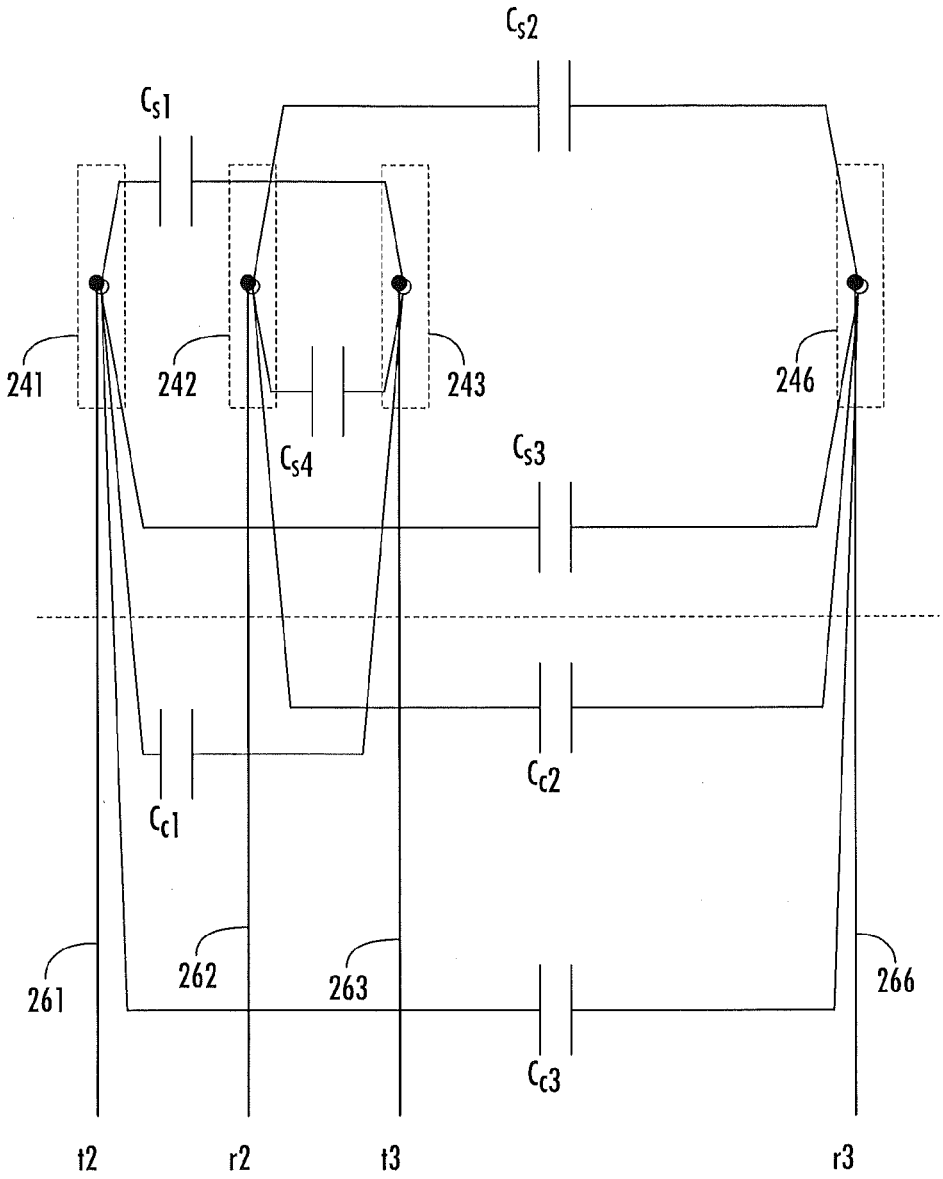
FIGS. 13A-13C are schematic diagrams of crosstalk compensation schemes for communications plugs according to embodiments of the present invention.
Figure 13B:
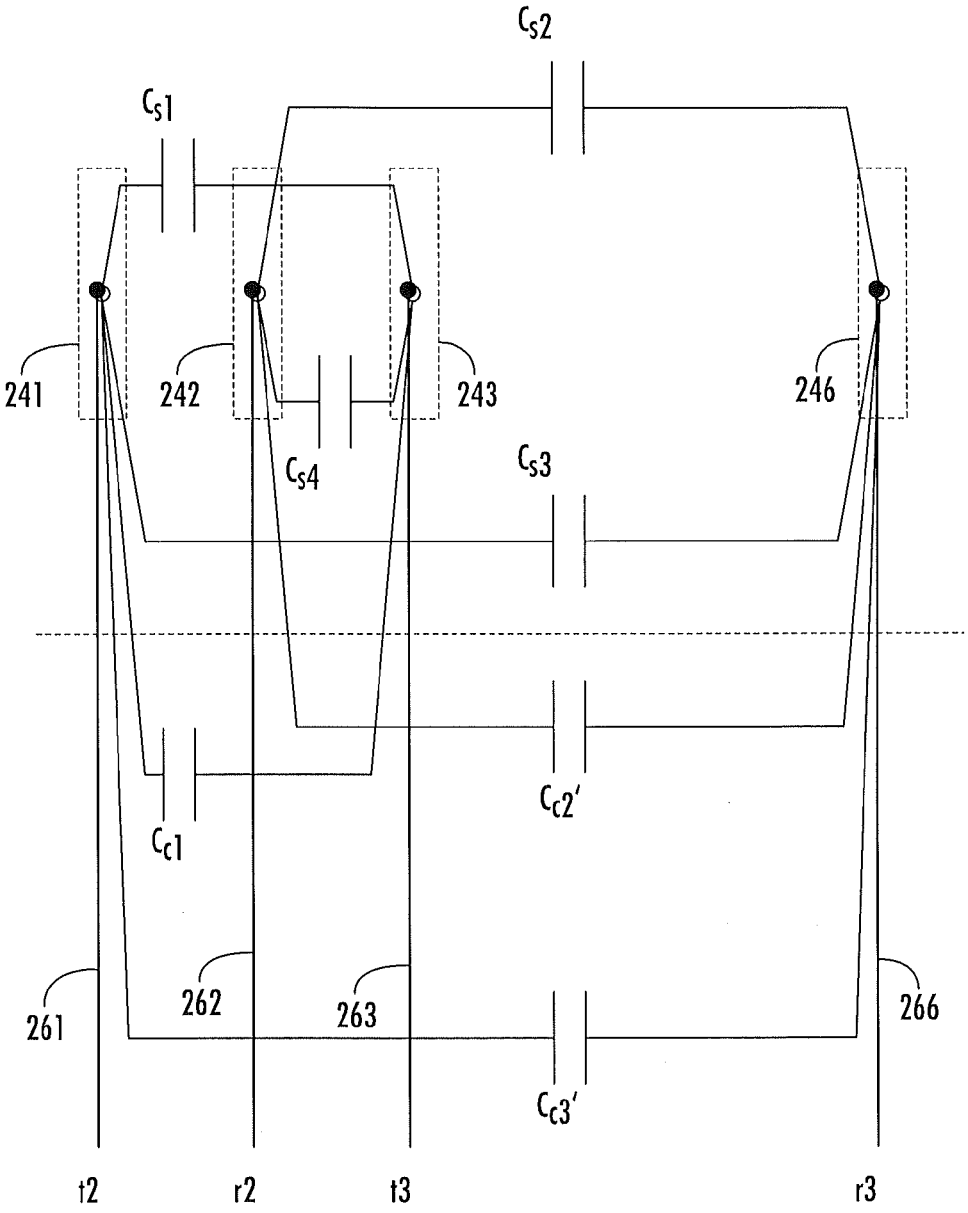
Figure 13C:
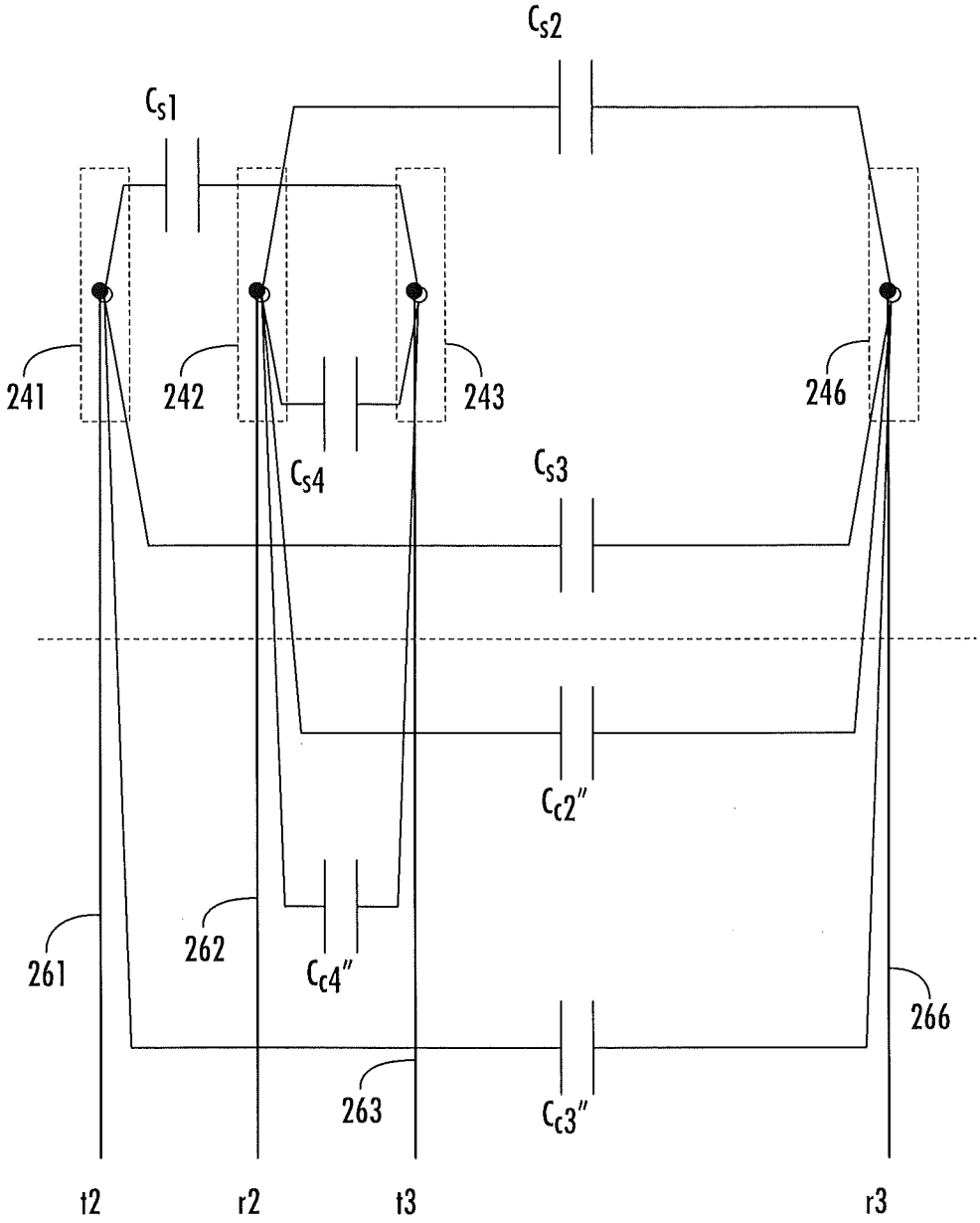

FIGS. 13A-13C are schematic diagrams of crosstalk compensation schemes for communications plugs according to embodiments of the present invention. In FIGS. 13A-13C, only the conductive paths and plug blades of pairs 2 and 3 are illustrated (namely, conductive paths 261-263 and 266 and plug blades 241-243 and 246) in order to simplify the drawings. The plug blades 241-243 and 246 may, for example, be identical to the plug blades 141-143 and 146 included in the plug 116 that is discussed above.

As noted above, it may be advantageous to reduce the amount of differential-to-common mode crosstalk that arises in a communications plug in order to reduce or eliminate any need to compensate for this crosstalk in a mating jack. However, unlike a mated plug-jack combination, many communications plugs such as plugs that comply with the ANSI/TIA-568-C.2 standard are required to exhibit specified levels of offending differential-to-differential crosstalk between the various transmission lines through the plug. Pursuant to embodiments of the present invention, communications plugs are provided that may exhibit little or no differential-to-common mode crosstalk between various pair combinations while providing the requisite levels of differential-to-differential crosstalk between each pair combination. The plugs according to embodiments of the present invention include a plurality of crosstalk injection circuits that inject crosstalk between various of the conductive paths through the plug where the magnitudes of the crosstalk injected by these circuits are selected to cancel the differential-to-common-mode crosstalk while providing the requisite levels of offending differential-to-differential crosstalk.

The crosstalk injection circuits that are provided and methods for selecting the values for these crosstalk injection circuits will now be discussed with reference to FIG. 13A. FIG. 13A illustrates a crosstalk compensation scheme for pairs 2 and 3 in a four pair communications plug that may be used, for example, in plugs having plug blades that inject more differential-to-differential crosstalk than is required by the relevant industry standards document.

As is apparent from FIG. 13A, crosstalk will inherently arise between the plug blades 241-243 and 246. This crosstalk will typically include both capacitive coupling and inductive coupling (with more capacitive coupling than inductive coupling). This inherent crosstalk is represented in FIGS. 13A-13C as four crosstalk couplings Cs1, Cs2, Cs3, and Cs4. Coupling Cs1 represents the crosstalk coupled between plug blade 241 and plug blade 243, coupling Cs2 represents the crosstalk coupled between plug blade 242 and plug blade 246, coupling Cs3 represents the crosstalk coupled between plug blade 241 and plug blade 246, and coupling Cs4 represents the crosstalk coupled between plug blade 242 and plug blade 243. While these couplings Cs1, Cs2, Cs3 and Cs4 are shown as being capacitive in nature, it will be appreciated that they will also typically include an inductive component. The values of couplings Cs1, Cs2, Cs3 and Cs4 are determined by the geometries of the plug blades and the electrical properties of the medium material (as well as the geometries of the conductive traces that are electrically connected to the plug blades), and can be measured directly or inferred from measurements of actual crosstalk levels.

As shown in FIG. 13A, a plurality of crosstalk injection circuits are also coupled between the conductors of pairs 2 and 3. In the embodiments of FIG. 13A, these crosstalk injection circuits include a first crosstalk injection circuit Cc1 that is connected between conductive path 261 (the tip line of pair 2) and conductive path 263 (the tip line of pair 3), a second crosstalk injection circuit Cc2 that is connected between conductive path 262 (the ring line of pair 2) and conductive path 266 (the ring line of pair 3), and a third crosstalk injection circuit Cc3 that is connected between conductive path 261 and conductive path 266. As shown in FIG. 13A, in one example implementation the crosstalk injection circuits Cc1, Cc2, and Cc3 may be implemented as capacitors that are connected at or directly adjacent to the plug blades 241-243 and 246 in order to inject the "compensating" crosstalk provided by circuits Cc1, Cc2, and Cc3 at or very near the injection point of the "offending" crosstalk Cs1, Cs2, Cs3 and Cs4. If the magnitudes of the crosstalk injected by crosstalk injection circuits Cc1, Cc2, and Cc3 are chosen correctly, the differential-to-common-mode couplings between pairs 2 and 3 may be substantially canceled while still providing the requisite level of offending differential-to-differential crosstalk between pairs 2 and 3, regardless which of the two pairs is driven and which is idle.

The following analysis shows how to calculate the amount of crosstalk to inject between pairs 2 and 3 using the crosstalk injection circuits Cc1, Cc2 and Cc3 in order to substantially cancel the differential-to-common-mode crosstalk while achieving the requisite amount of differential-to-differential crosstalk between pairs 2 and 3. The differential-to-differential and differential-to-common-mode crosstalk coupling effects in the crosstalking region can be represented by Equations (1)-(3) as follows:

$$Csu=Cs3+Cs4-Cs1-Cs2 \tag{1}$$

$$Csb23=Cs2+Cs4-Cs1-Cs3 \tag{2}$$

$$Csb32=Cs1+Cs4-Cs2-Cs3 \tag{3}$$

where:

Csu is the unbalanced coupling (both capacitive and inductive) in the crosstalking region, responsible for differential-to-differential crosstalk between pairs 2 and 3;

Csb23 is the balanced coupling (both capacitive and inductive) in the crosstalking region, responsible for differential-to-common-mode crosstalk when pair 2 is driven and pair 3 is idle; and Csb32 is the balanced coupling (both capacitive and inductive) in the crosstalking region, responsible for differential-to-common-mode crosstalk when pair 3 is driven and pair 2 is idle.

The term "unbalanced coupling" describes the total coupling between two pairs that contributes to differential-to-differential crosstalk, and the term "balanced coupling" describes the total coupling between two pairs contributing to differential-to-common-mode crosstalk. For total differential-to-common mode crosstalk cancellation while providing the industry-standardized amount of differential-to-differential crosstalk between pairs 2 and 3, the three crosstalk injection circuits Cc1, Cc2, and Cc3 should be chosen to produce balanced couplings that are equal to and opposite in polarity to those in the crosstalking region while producing unbalanced couplings that are equal to and opposite in polarity to in the crosstalking region minus the industry-standardized amount of offending crosstalk. Thus, the three crosstalk injection circuits Cc1, Cc2, and Cc3 should inject crosstalk having the magnitudes expressed in Equations (4)-(6) as follows:

$$-Csu=Cc3-Cc1-Cc2-K \tag{4}$$

$$-Csb23=Cc2-Cc1-Cc3 \tag{5}$$

$$-Csb32=Cc1-Cc2-Cc3 \tag{6}$$

where:

K is the magnitude of the offending differential-to-differential crosstalk that should be injected between pairs 2 and 3 according to the industry standards.

Solving Equations (4)-(6) for Cc1, Cc2, and Cc3 yields Equations (7)-(9) as follows:

$$Cc1=(Csu+Csb23-K)/2 \quad (7)$$

$$Cc2=(Csu+Csb32-K)/2 \quad (8)$$

$$Cc3=(Csb23+Csb32)/2 \quad (9)$$

Substituting for Csu, Csb23, and Csb32 from Equations (1)-(3) into Equations (7)-(9) yields Equations (10)-(12) as follows:

$$Cc1=Cs4-Cs1-K/2 \quad (10)$$

$$Cc2=Cs4-Cs2-K/2 \quad (11)$$

$$Cc3=Cs4-Cs3 \quad (12)$$

As indicated by Equations (10)-(12), knowing Cs1, Cs2, Cs3, and Cs4, the values of Cc1, Cc2, and Cc3 can be calculated. The same can be achieved by inferring Csu, Csb23, and Csb32 from differential-to-differential and differential-to-common-mode crosstalk measurements performed for the crosstalking region.

While the above analysis uses three crosstalk injection circuits Cc1, Cc2 and Cc3 to inject crosstalk that will substantially cancel the differential-to-common mode crosstalk while leaving the industry standardized amount of differential-to-differential offending crosstalk between pairs 2 and 3, it will be appreciated that a fourth crosstalk injection circuit Cc4 could be added between R2 and T3. The addition of this fourth crosstalk injection circuit Cc4 provides an additional degree of freedom.

Subtracting above equation (11) from above equation (10) yields, $$Cc1-Cc2=Cs2-Cs1 \quad (13)$$

Typically Cs1 is greater that Cs2, since plug blade 241 is physically closer to plug blade 243 than is plug blade 242 to plug 246 for the pairs 2 and 3. As a consequence of this and above equation (10), Cc2 has to be greater than Cc1 for positive values of Cc1 and Cc2. This implies that the compensation scheme of FIG. 13A cannot have an offending crosstalk greater than the amount that would result from having Cc1=0. This maximum differential-to-differential offending crosstalk achievable using the compensation scheme of FIG. 13A can be derived by substituting Cc1=0 into above equation (10), which yields, $$K=2(Cs4-Cs1) \quad (14)$$

Thus the crosstalk compensation scheme of FIG. 13A is applicable when the required offending differential-to-differential crosstalk between pairs 2 and 3 is less than twice amount of coupling between plug blade 242 and plug blade 243 minus twice the amount of coupling between plug blade 241 and plug blade 243.

Next, reference is made to FIG. 13B, which illustrates the crosstalk compensation scheme for pairs 2 and 3 in a four pair communications plug that may be used, for example, if the amount of differential-to-differential crosstalk that is specified by the relevant industry standards document is equal to twice amount of coupling between plug blade 242 and plug blade 243 minus twice the amount of coupling between plug blade 241 and plug blade 243.

As shown in FIG. 13B, in this embodiment, only two crosstalk injection circuits are used: namely, the second crosstalk injection circuit Cc2' that is connected between conductive paths 262 and 266; and the third crosstalk injection circuit Cc3' that is connected between conductive paths 261 and 266. The crosstalk injection circuits Cc2' and Cc3' may again be implemented as capacitors that are connected at or directly adjacent to the plug blades 241-242 and 246 in order to inject the "compensating" crosstalk provided by circuits Cc2' and Cc3' at or very near the injection point of the "offending" crosstalk Cs1, Cs2, Cs3, Cs4. If the magnitudes of the crosstalk injected by crosstalk injection circuits Cc2' and Cc3' are chosen correctly, the differential-to-common-mode couplings between pairs 2 and 3 may be substantially canceled while still providing the requisite level of offending differential-to-differential crosstalk between pairs 2 and 3, regardless which of the two pairs is driven and which is idle. In particular, to achieve this result Cc2' and Cc3' should have the following values based on Equations (11) and (12) above $$Cc2'=Cs4-Cs2-K/2 \quad (15)$$

$$Cc3'=Cs4-Cs3 \quad (16)$$

Finally, reference is made to FIG. 13C, which illustrates a crosstalk compensation scheme for pairs 2 and 3 in a four pair communications plug that may be used, for example, if the amount of differential-to-differential crosstalk that is specified by the relevant industry standards document is greater than twice amount of coupling between plug blade 242 and plug blade 243 minus twice the amount of coupling between plug blade 241 and plug blade 243.

As shown in FIG. 13C, in this embodiment, three crosstalk injection circuits may be used, namely the second crosstalk injection circuit Cc2" that is connected between conductive paths 262 and 266, the third crosstalk injection circuit Cc3" that is connected between conductive paths 261 and 266, and a fourth crosstalk injection circuit Cc4" that is connected between conductive paths 262 and 263. The crosstalk injection circuits Cc2", Cc3" and Cc4" may again be implemented as capacitors that are connected at or directly adjacent to the plug blades 241-243 and 246. If the magnitudes of the crosstalk injected by crosstalk injection circuits Cc2", Cc3", and Cc4" are chosen correctly, the differential-to-common-mode couplings between pairs 2 and 3 may be substantially canceled while still providing the requisite level of offending differential-to-differential crosstalk between pairs 2 and 3, regardless which of the two pairs is driven and which is idle. In particular, to achieve this result Cc2", Cc3" and Cc4" should be chosen such that:

$$-Csu=Cc3''+Cc4''-Cc2''-K \quad (17)$$

$$-Csb23=Cc2''+Cc4''-Cc3'' \quad (18)$$

$$-Csb32=Cc4''-Cc2''-Cc3'' \quad (19)$$

Solving Equations (17) through (19) for Cc2", Cc3", and Cc4" yields Equations (20) through (22) as follows:

$$Cc2''=(Csb32-Csb23)/2 \quad (20)$$

$$Cc3''=(Csb32-Csu+K)/2 \quad (21)$$

$$Cc4''=(-Csb23-Csu+K)/2 \quad (22)$$

Substituting for Csu, Csb23, and Csb32 from Equations (1) through (3) into Equations (20) through (22) yields Equations (23) through (25) as follows:

$$Cc2''=Cs1-Cs2 \quad (23)$$

$$Cc3''=Cs1-Cs3+K/2 \quad (24)$$

$$Cc4''=Cs1-Cs4+K/2 \quad (25)$$

As shown in the analysis above, the solution presented with respect to FIG. 13A may be used if the requisite differential-to-differential coupling between pairs 2 and 3 is less than 2(Cs4-Cs1). The solution presented with respect to FIG. 13B may be used if the requisite differential-to-differential coupling between pairs 2 and 3 is substantially equal to 2(Cs4-Cs1). The solution presented with respect to FIG. 13C may be used if the requisite differential-to-differential coupling between pairs 2 and 3 is greater than 2(Cs4-Cs1). It will also be appreciated that while the scenarios of FIGS. 13B and 13C have been solved assuming that two or three crosstalk injection circuits are used, as with the scenario of FIG. 13A, all four crosstalk injection circuits may also be used in these scenarios, providing at least one additional degree of freedom with respect to solutions that substantially cancel the differential-to-common-mode couplings between pairs 2 and 3 while providing the requisite level of offending differential-to-differential crosstalk between pairs 2 and 3.

It will also be appreciated that the above calculations derive values for the four crosstalk injection circuits that provide solutions for pairs 2 and 3 of a four pair connector. Those skilled in the art will understand that the above analysis is equally applicable to pairs 3 and 4 and that the same principles can be extended to derive values for crosstalk injection circuits that will compensate for crosstalk between other pair combinations in a four pair connector or for pair combinations in other types of mated plug-jack connectors.

It will be appreciated that the printed circuit board 150 that is illustrated in FIGS. 4-8 and 10 above could be modified to include the first, second, third and/or fourth various crosstalk injection circuits that are illustrated in FIGS. 13A-13C in order to implement these crosstalk compensation schemes in plug 116.

As noted above, in some embodiments, the first, second, third and/or fourth crosstalk injection circuits may be implemented as capacitors that inject the crosstalk close in time to the offending crosstalk Cs1, Cs2, Cs3 and Cs4. This may reduce and/or minimize the delay, which may more effectively cancel the differential-to-common mode crosstalk. However, differential-to-common mode crosstalk may appear as both NEXT and FEXT, and hence it may be desirable in some embodiments to include inductive components in at least some of the first, second, third and/or fourth crosstalk injection circuits in order to better cancel both differential-to-common mode NEXT and FEXT. However, at least some of the inductive components may have greater associated delays which may degrade the cancellation, and hence there may be inherent tradeoffs with respect to whether or not to include inductive components in the first, second, third and/or fourth crosstalk injection circuits, at least in some embodiments.

Thus, pursuant to some embodiments of the present invention, RJ-45 communications plugs (and related patch cords) are provided that include at least a first crosstalk injection circuit that is connected between a first conductive path of a first differential pair and a first conductive path of a second differential pair, and a second crosstalk injection circuit that is connected between the second conductive path of the first differential pair and the first conductive path of the second differential pair. The first and second crosstalk injection circuits may be designed to substantially cancel the differential-to-common mode crosstalk injected between the first and second differential pairs. In some embodiments, the plug may further include a third crosstalk injection circuit that is connected either (1) between the first conductive path of the first differential pair and the second conductive path of the second differential pair or (2) between the second conductive path of the first differential pair and the second conductive path of the second differential pair. This third crosstalk injection circuit may act in conjunction with the first and second crosstalk injection circuits to substantially cancel the differential-to-common mode crosstalk injected between the first and second differential pairs.

In some embodiments, the first, second and/or third crosstalk injections circuits may be implemented as capacitors on a printed circuit board of the plug. These capacitors may, for example, inject crosstalk onto the signal carrying paths directly adjacent to the connection of each path to its respective plug blade.

As is also made clear above, the plugs (specifically including RJ-45 plugs) according to embodiments of the present invention may include a differential-to-common mode crosstalk cancellation circuit that substantially cancels differential-to-common mode crosstalk that is injected within the plug from a first differential transmission line onto a second differential transmission line while still ensuring that differential-to-differential crosstalk is injected from the first differential transmission line onto the second differential transmission line when the first differential transmission line is excited differentially. The amount of differential-to-differential crosstalk that is injected may, for example, be the amount specified in a relevant industry standards document.

The plugs according to embodiments of the present invention thus may include an offending crosstalk circuit that is separate from the plug blades that injects crosstalk between first and second differential transmission lines, where the offending crosstalk circuit is between a ring conductive path and a tip conductive path, as well as a differential-to-common mode crosstalk cancellation circuit that is electrically connected between the first and second differential transmission lines. The differential-to-common mode crosstalk cancellation circuit may substantially cancel the differential-to-common mode crosstalk that is injected within the plug between the first and second differential transmission lines.

Thus, using the above-described techniques, mode conversion between for example, pairs 2 and 3 may be managed (i.e., cancelled) in the communications plug. This may reduce any need to compensate for mode conversion in a mating communications jack. As known to those of skill in the art, one technique for compensating for mode conversion in a four-pair T-568B type communications jack is to include a crossover on pair 3 as is described, for example, in the above-referenced U.S. Pat. No. 7,204,722. However, as communications plugs and jacks are designed to operate at higher data rates, it may be difficult to physically implement such crossovers in a reliable fashion so that they will inject the compensating crosstalk at sufficiently short delays. Thus, by compensating for the differential-to-common mode crosstalk in the communications plug it may be possible to omit such crossovers in some jack designs.

It will be appreciated that in shielded communications systems, the impact of differential-to-common mode crosstalk may be reduced as the shielding may reduce the amount of alien crosstalk in the communications system. However, the plugs according to embodiments of the present invention may still be useful in shielded communications systems for various reasons including further reducing the amount of alien crosstalk and improving insertion loss performance.

Figure 14:
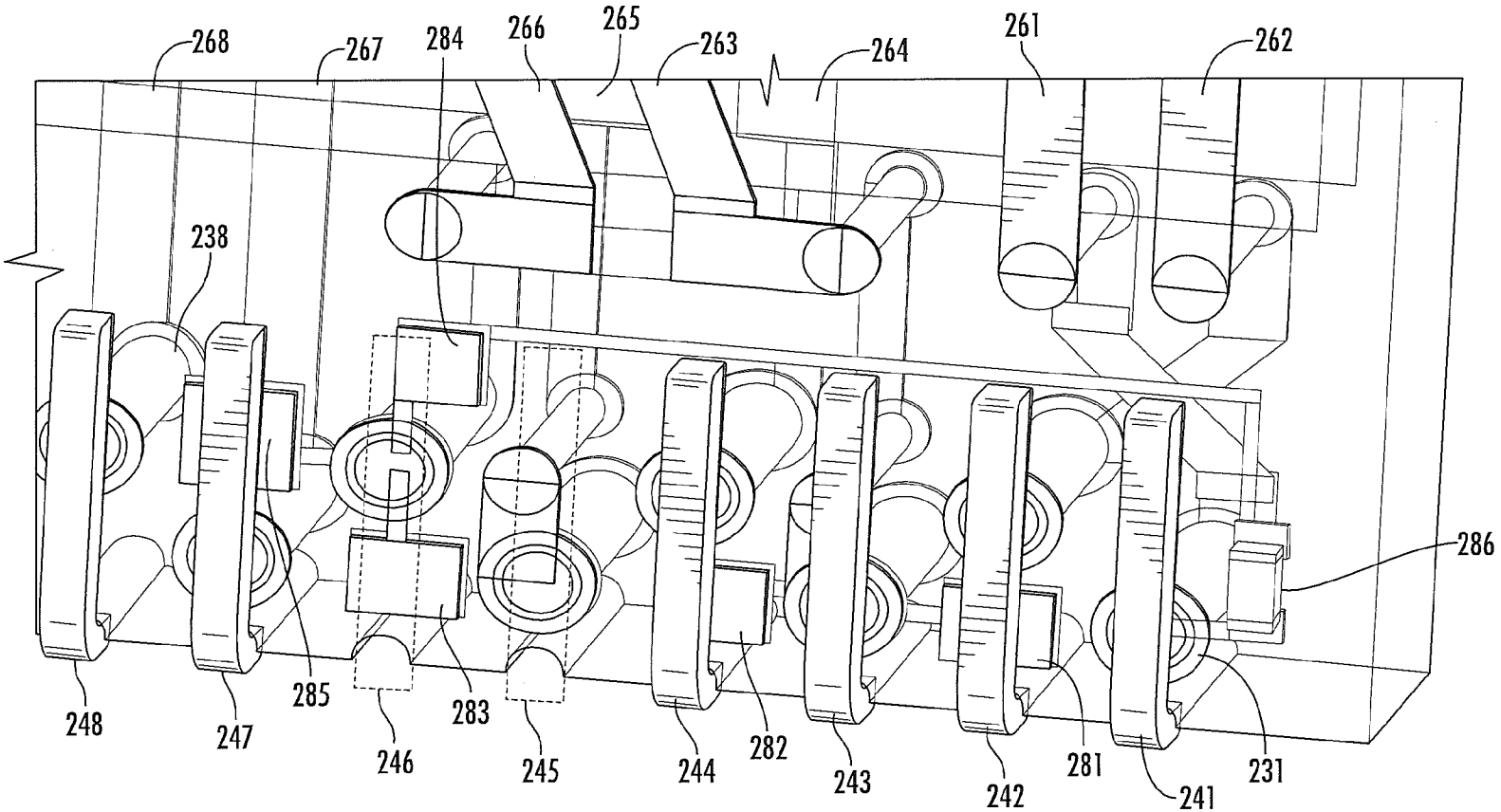
FIG. 14 is a perspective view of the blades and printed circuit board of a communications plug according to further embodiments of the present invention.

Pursuant to further embodiments of the present invention, resistors may be placed in series with one or more of the first, second, third and/or fourth crosstalk injection circuits. These series resistors may further reduce mode conversion and/or facilitate managing the return loss along one or more of the differential transmission lines. FIG. 14 is a perspective view of some of the plug blades and a portion of a printed circuit board 250 of a communications plug according to further embodiments of the present invention that includes such a series resistor.

As shown in FIG. 14, the printed circuit board 250 includes a plurality of conductive vias 231-238 and a plurality of conductive paths 261-268. A plurality of plug blades 241-248 are mounted in the respective conductive vias 231-238. Plug blades 245 and 246 are shown using dotted lines in FIG. 14 in order to better illustrate capacitors that are included underneath those plug blades. The conductive vias 231-238, the conductive paths 261-268, and the plug blades 241-248 may be identical to the conductive vias 131-138, the conductive paths 161-168 and the plug blades 141-148 that are described above with respect to FIGS. 5-8 except as described below.

As is further shown in FIG. 14, a plurality of capacitors 281-285 are provided in the printed circuit board 250. Each of these capacitors is implemented as a plate capacitor that has a first plate on a first layer of the printed circuit board 250 that electrically connects to a first of the conductive paths 261-268 and a second plate on a second layer of the printed circuit board 250 that electrically connects to a second of the conductive paths 261-268. In particular, capacitor 281 is interposed between conductive paths 262 and 263, capacitor 282 is interposed between conductive paths 263 and 264, capacitor 283 is interposed between conductive paths 265 and 266, capacitor 284 is interposed between conductive paths 261 and 266, and capacitor 285 is interposed between conductive paths 266 and 267. The capacitors 281-285 may be configured to ensure that the plug exhibits the industry standards required amounts of offending crosstalk between the different pair combinations, and may also be used to at least partially cancel differential-to-common mode crosstalk that arises between pairs in the plug.

As is further shown in FIG. 14, a resistor 286 is provided in series with the capacitor 284 between conductive path 261 and conductive path 266. In an example embodiment, the resistor 286 may be a 1000 ohm resistor and the capacitor 284 may be a 0.1 pF capacitor. The resistor 286 may improve return loss on conductive path 261 by increasing the impedance of the connection to capacitor 284 and so reducing its effect as an electrical stub; and it may also limit the crosstalk between conductive path 261 and conductive path 266 at high frequencies. Additional resistors may be provided in series with any other of the capacitors 281-283 and 285.

While in the description above with reference to FIGS. 13A-13C and 14 the analysis is made with reference to pairs 3 and 2 according the TIA 568 type B pair assignment counting the plug blades as shown in FIG. 8 from left to right, it will be appreciated that if the conductors are counted from the opposite direction the description would apply equally well to pairs 3 and 4 of the TIA 568 type B pair assignment. Thus, the above description and the pending claims cover both cases.

The present invention is not limited to the illustrated embodiments discussed above; rather, these embodiments are intended to fully and completely disclose the invention to those skilled in this art. In the drawings, like numbers refer to like elements throughout. Thicknesses and dimensions of some components may be exaggerated for clarity.

Spatially relative terms, such as "top," "bottom," "side," "upper," "lower" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "under" or "beneath" other elements or features would then be oriented "over" the other elements or features. Thus, the exemplary term "under" can encompass both an orientation of over and under. The device may be otherwise oriented (rotated 90 degrees or at other orientations) and the spatially relative descriptors used herein interpreted accordingly.

Herein, the term "signal current carrying path" is used to refer to a current carrying path on which an information signal will travel on its way from the input to the output of a communications plug. Signal current carrying paths may be formed by cascading one or more conductive traces on a wiring board, metal-filled apertures that physically and electrically connect conductive traces on different layers of a printed circuit board, portions of plug blades, conductive pads, and/or various other electrically conductive components over which an information signal may be transmitted. Branches that extend from a signal current carrying path and then dead end such as, for example, a branch from the signal current carrying path that forms one of the electrodes of an inter-digitated finger or plate capacitor, are not considered part of the signal current carrying path, even though these branches are electrically connected to the signal current carrying path. While a small amount of current will flow into such dead end branches, the current that flows into these dead end branches generally does not flow to the output of the plug that corresponds to the input of the plug that receives the input information signal.

Well-known functions or constructions may not be described in detail for brevity and/or clarity. As used herein the expression "and/or" includes any and all combinations of one or more of the associated listed items.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises", "comprising", "includes" and/or "including" when used in this specification, specify the presence of stated features, integers, steps, operations, elements, and/or components, but do not preclude the presence or addition of one or more other features, integers, steps, operations, elements, components, and/or groups thereof.

All of the above-described embodiments may be combined in any way to provide a plurality of additional embodiments.

The foregoing is illustrative of the present invention and is not to be construed as limiting thereof. Although exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention as defined in the claims. The invention is defined by the following claims, with equivalents of the claims to be included therein.

That which is claimed is:

1. A patch cord comprising:

a communications cable that includes first through eighth conductors, wherein the fourth and fifth conductors are twisted together to form a first twisted pair, the first and second conductors are twisted together to form a second twisted pair, the third and sixth conductors are twisted together to form a third twisted pair, and the seventh and eighth conductors are twisted together to form a fourth twisted pair; and a plug that is attached to the communications cable, the plug comprising:

a housing that receives the communications cable;

first through eighth plug contacts;

a printed circuit board that is at least partly within the housing, the printed circuit board including first through eighth conductive paths that connect the first through eighth conductors to the respective first through eighth plug contacts; and a first crosstalk injection circuit between the second conductive path and the sixth conductive path; and a second crosstalk injection circuit between the first conductive path and the sixth conductive path.

2. The patch cord of claim 1, wherein the first and second crosstalk injection circuits substantially cancel the common mode crosstalk injected from the third twisted pair onto the second twisted pair when the third twisted pair is excited differentially.

3. The patch cord of claim 1, further comprising a third crosstalk injection circuit between the second conductive path and the third conductive path.

4. The patch cord of claim 3, wherein the first, second and third crosstalk injection circuits substantially cancel the common mode crosstalk injected from the third twisted pair onto the second twisted pair when the third twisted pair is excited differentially.

5. The patch cord of claim 1, further comprising a third crosstalk injection circuit between the first conductive path and the third conductive path.

6. The patch cord of claim 5, wherein the first, second and third crosstalk injection circuits substantially cancel the common mode crosstalk injected from the third twisted pair onto the second twisted pair when the third twisted pair is excited differentially.

7. The patch cord of claim 1, wherein the first crosstalk injection circuit comprises a first capacitor on the printed circuit board between the second conductive path and the sixth conductive path.

8. The patch cord of claim 6, wherein the second crosstalk injection circuit comprises a second capacitor on the printed circuit board between the first conductive path and the sixth conductive path.

9. The patch cord of claim 8, wherein the first capacitor connects to the second conductive path directly adjacent the second plug contact and connects to the sixth conductive path directly adjacent the sixth plug contact.

10. The patch cord of claim 1, wherein the first through eighth plug contacts include plug contact regions that are substantially aligned in a row in numerical order.

11. An RJ-45 communications plug that has first through eighth conductive paths where the fourth and fifth conductive paths are part of a first differential transmission line, the first and second conductive paths are part of a second differential transmission line, the third and sixth conductive paths are part of a third differential transmission line, and the seventh and eighth conductive paths are part of a fourth differential transmission line, wherein the first, third, fifth and seventh conductive paths are tip conductive paths and the second, fourth, sixth and eighth conductive paths are ring conductive paths, the plug comprising:

a housing;

first through eighth plug blades that are at least partially within the housing and that are electrically connected to the respective first through eighth conductive paths, the first through eighth plug blades aligned in a row in numerical order;

an offending crosstalk circuit that is separate from the plug blades that injects crosstalk between the second and third differential transmission lines, where the offending crosstalk circuit is between a ring conductive path and a tip conductive path; and a differential-to-common mode crosstalk cancellation circuit that is electrically connected between the second differential transmission line and the third differential transmission line.

12. The RJ-45 communications plug of claim 11, wherein the differential-to-common mode crosstalk cancellation circuit substantially cancels common mode crosstalk that is injected within the plug from the third differential transmission line to the second differential transmission line when the third differential transmission line is excited differentially.

13. The RJ-45 communications plug of claim 11, wherein the differential-to-common mode crosstalk cancellation circuit includes a first reactive circuit between the second conductive path and the sixth conductive path, a second reactive circuit between the first conductive path and the sixth conductive path and a third reactive circuit between the second conductive path and the third conductive path.

14. The RJ-45 communications plug of claim 13, wherein the first reactive circuit comprises a first capacitor on a printed circuit board, the second reactive circuit comprises a second capacitor on the printed circuit board and the third reactive circuit comprises a third capacitor on the printed circuit board.

15. The RJ-45 communications plug of claim 14, wherein the first capacitor connects to the second conductive path directly adjacent to a signal injection location on the second plug blade, and connects to the sixth conductive path directly adjacent to a signal injection location on the sixth plug blade.

16. The RJ-45 communications plug of claim 11, wherein differential crosstalk injected onto the second transmission line by the third differential transmission line when the third differential transmission line is excited differentially is greater than twice amount of coupling between the second plug blade and the third plug blade minus twice the amount of coupling between the first plug blade and the third plug blade.

17. The RJ-45 communications plug of claim 11, further comprising a communications cable that has first through eighth conductors that are electrically connected to the respective first through eighth conductive paths to provide a patch cord.

18. The RJ-45 communications plug of claim 11, wherein the offending crosstalk circuit comprises a capacitor, the RJ-45 communications plug further comprising a resistor coupled in series with the capacitor.

19. The RJ-45 communications plug of claim 11, wherein the differential-to-common mode crosstalk cancellation circuit comprises a capacitor, the RJ-45 communications plug further comprising a resistor coupled in series with the capacitor.

20. An RJ-45 communications plug that has first through eighth conductive paths that are arranged as first through fourth differential transmission lines, the plug comprising:

a housing;

first through eighth plug blades that are at least partially within the housing and that are electrically connected to the respective first through eighth conductive paths; and a capacitor and a resistor electrically coupled in series between two of the first through eighth conductive paths.

21. The RJ-45 communications plug of claim 20, wherein the capacitor is implemented on a printed circuit board of the plug and the resistor comprises a surface mount resistor on the printed circuit board.

22. The RJ-45 communications plug of claim 20, wherein the series resistor and capacitor are interposed between the second conductive path and the sixth conductive path.

* * * * *